US009266014B2

(12) United States Patent
Dayal et al.

(10) Patent No.: US 9,266,014 B2
(45) **Date of Patent: *Feb. 23, 2016**

(54) SYSTEM AND METHOD FOR PROVIDING A TABLE GAME

(71) Applicant: ThrowMotion, Inc., Sunnyvale, CA (US)

(72) Inventors: Aditya Dayal, Sunnyvale, CA (US); Tom Grimm, Napa, CA (US); Seth Heltsley, San Francisco, CA (US)

(73) Assignee: ThrowMotion, Inc., Sunnyvale, CA (US)

( * ) Notice: Subject to any disclaimer, the term of this patent is extended or adjusted under 35 U.S.C. 154(b) by 57 days.

This patent is subject to a terminal disclaimer.

(21) Appl. No.: 13/676,085

(22) Filed: Nov. 13, 2012

(65) Prior Publication Data

US 2014/0035226 A1 Feb. 6, 2014

Related U.S. Application Data

(63) Continuation-in-part of application No. 12/630,736, filed on Dec. 3, 2009, now Pat. No. 8,360,435.

(60) Provisional application No. 61/200,874, filed on Dec. 3, 2008.

(51) Int. Cl.

| | |
|---|---|
| ***A63F 7/06*** | (2006.01) |
| ***A63F 7/20*** | (2006.01) |
| *A63F 7/34* | (2006.01) |
| *A63F 9/24* | (2006.01) |

(52) U.S. Cl.

CPC ..... *A63F 7/0608* (2013.01); *A63F 7/0664* (2013.01); *A63F 7/20* (2013.01); *A63F 2007/345* (2013.01); *A63F 2009/2458* (2013.01)

(58) Field of Classification Search

CPC ... A63F 7/0664; A63F 7/20; A63F 2007/345; A63F 7/0608; A63F 2009/2458

USPC ..... 273/108–129 W, 317.6–317.9, 237, 238, 273/259, 277, 461; 124/7, 16, 36; 473/451

See application file for complete search history.

(56) References Cited

U.S. PATENT DOCUMENTS

| | | | |
|---|---|---|---|
| 861,841 | A | 7/1907 | Heitmann |
| 968,249 | A | 8/1910 | Meeker |
| 983,250 | A | 1/1911 | Porter |
| 1,008,898 | A | 11/1911 | Fulton et al. |

(Continued)

OTHER PUBLICATIONS

International Search Report and Written Opinion for PCT/US2009/066650, mailed Feb. 4, 2010 (7 pages).

*Primary Examiner* — Sebastiano Passaniti
(74) *Attorney, Agent, or Firm* — Steptoe & Johnson LLP

(57) ABSTRACT

A mechanical ball launcher for a table game is disclosed. According to one embodiment, the mechanical ball launcher has a body that rotates about a first axis. The body has a launch arm that extends along a second axis that is substantially perpendicular to the first axis. The launch arm has a ball receptacle at a terminal end. The mechanical ball launcher has a supporting plate supporting the body and a mechanical spring connected between the body and the supporting plate. The mechanical spring is placed in a loaded position when the launch arm is pulled back. A launch angle, a lateral angle, and a speed of the ball are adjusted as the ball is launched from the ball receptacle of the mechanical ball launcher.

23 Claims, 16 Drawing Sheets

(56) References Cited

U.S. PATENT DOCUMENTS

| | | | | | |
|---|---|---|---|---|---|
| 1,329,291 | A | | 1/1920 | Chapman | |
| 1,621,230 | A | | 3/1927 | Barr | |
| 1,626,778 | A | | 5/1927 | Barker | |
| 2,008,052 | A | | 7/1935 | Walker | |
| 2,075,960 | A | | 4/1937 | Reichel | |
| 2,233,685 | A | | 3/1941 | Simmons | |
| 2,362,188 | A | | 11/1944 | Clark | |
| 2,462,170 | A | | 2/1949 | Dube | |
| 2,775,457 | A | | 12/1956 | Galbos | |
| 3,009,452 | A | | 11/1961 | Barber et al. | |
| 3,091,459 | A | | 5/1963 | Lindman | |
| 3,730,525 | A | | 5/1973 | Maeda | |
| 3,814,425 | A | | 6/1974 | Kanefield et al. | |
| 3,879,037 | A | | 4/1975 | Cooke | |
| 3,883,139 | A | | 5/1975 | Morrison | |
| 4,017,074 | A | * | 4/1977 | Roberts | 273/108.31 |
| 4,065,130 | A | | 12/1977 | Geraci | |
| 4,179,123 | A | | 12/1979 | Tsukuda | |
| 4,216,961 | A | | 8/1980 | McQuillan | |
| 4,324,402 | A | | 4/1982 | Klose | |
| 4,327,913 | A | | 5/1982 | Bock | |
| 4,877,244 | A | | 10/1989 | Burrows et al. | |
| 4,976,434 | A | | 12/1990 | Wikner | |
| 5,060,945 | A | | 10/1991 | Irvine | |
| 5,125,658 | A | | 6/1992 | Francis et al. | |
| 5,409,221 | A | | 4/1995 | Cohn | |
| 5,464,208 | A | * | 11/1995 | Pierce | 473/451 |
| 5,533,722 | A | | 7/1996 | Lu | |
| 5,655,767 | A | | 8/1997 | Francis et al. | |
| 5,700,008 | A | | 12/1997 | Lawlor et al. | |
| 5,975,527 | A | * | 11/1999 | Winchester | 273/129 V |
| 6,186,133 | B1 | | 2/2001 | Battersby et al. | |
| 6,286,832 | B1 | | 9/2001 | Willers | |
| 6,461,237 | B1 | | 10/2002 | Yoshinobu et al. | |
| 6,505,617 | B1 | * | 1/2003 | Neuman | 124/7 |
| 6,533,272 | B2 | | 3/2003 | Hylak et al. | |
| 6,561,511 | B1 | | 5/2003 | Vaysberg et al. | |
| 6,585,269 | B1 | | 7/2003 | Lee | |
| 6,695,308 | B2 | | 2/2004 | Hylak et al. | |
| 6,805,348 | B1 | | 10/2004 | Chen | |
| 7,207,564 | B2 | | 4/2007 | Bedford et al. | |
| 7,325,803 | B1 | | 2/2008 | Miranda | |
| 7,691,012 | B2 | | 4/2010 | Cucjen et al. | |
| 8,360,435 | B2 | * | 1/2013 | Dayal et al. | 273/317.7 |
| 8,381,709 | B2 | * | 2/2013 | Woessner et al. | 124/7 |
| 2001/0030392 | A1 | | 10/2001 | Huang | |

* cited by examiner

SYSTEM AND METHOD FOR PROVIDING A TABLE GAME

The present application claims the benefit of and priority to U.S. Provisional Patent Application Ser. No. 61/200,874 filed on Dec. 3, 2008, and is a continuation-in-part of U.S. patent application Ser. No. 12/630,736, now issued to U.S. Pat. No. 8,360,435, which are hereby incorporated by reference.

FIELD

The present application relates to a game system. More particularly, the present invention is a system and method for providing an electromechanically controlled table game.

BACKGROUND

Table games refer to interactive games played by one or more players on a raised platform (or table). Table games may be played indoors or outdoors. Exemplary table games include table tennis, pool, billiards, foosball, and air hockey.

Cricket is a popular sport in India, the United Kingdom, Australia, the Caribbean, and South Africa and is rapidly gaining popularity in other countries. A few cricket table games or board games are currently available but the existing games do not provide realistic physical actions or realistic ball dynamics, hence they do not offer game players the reality and the excitement of a real game of cricket. For example, Wicketz is a cricket board game published by RDA Marketing of the United Kingdom that simulates pitching of a ball with a spinning bowling indicator. A batsman's stroke of a bat is determined by picking up a card.

Another example of a cricket board game is Super Cricket published by Toy Brokers Limited of the United Kingdom. In Super Cricket, a spring-loaded bowler rolls a ball on the surface of the game table. A batsman hits the rolled ball while keeping the bat in contact with the surface of the game table. None of these board games provides the reality of a real cricket game.

SUMMARY

A mechanical ball launcher for a table game is disclosed. According to one embodiment, the mechanical ball launcher has a body that rotates about a first axis. The body has a launch arm that extends along a second axis that is substantially perpendicular to the first axis. The launch arm has a ball receptacle at a terminal end. The mechanical ball launcher has a supporting plate supporting the body and a mechanical spring connected between the body and the supporting plate. The mechanical spring is placed in a loaded position when the launch arm is pulled back. A launch angle, a lateral angle, and a speed of the ball are adjusted as the ball is launched from the ball receptacle of the mechanical ball launcher.

The above and other preferred features, including various novel details of implementation and combination of elements, will now be more particularly described with reference to the accompanying drawings and pointed out in the claims. It will be understood that the particular methods and apparatuses are shown by way of illustration only and not as limitations. As will be understood by those skilled in the art, the principles and features explained herein may be employed in various and numerous embodiments.

BRIEF DESCRIPTION OF THE DRAWINGS

The accompanying drawings, which are included as part of the present specification, illustrate the presently preferred embodiment of the present invention and together with the general description given above and the detailed description of the preferred embodiment given below serve to explain and teach the principles of the present invention.

Figure 1A:
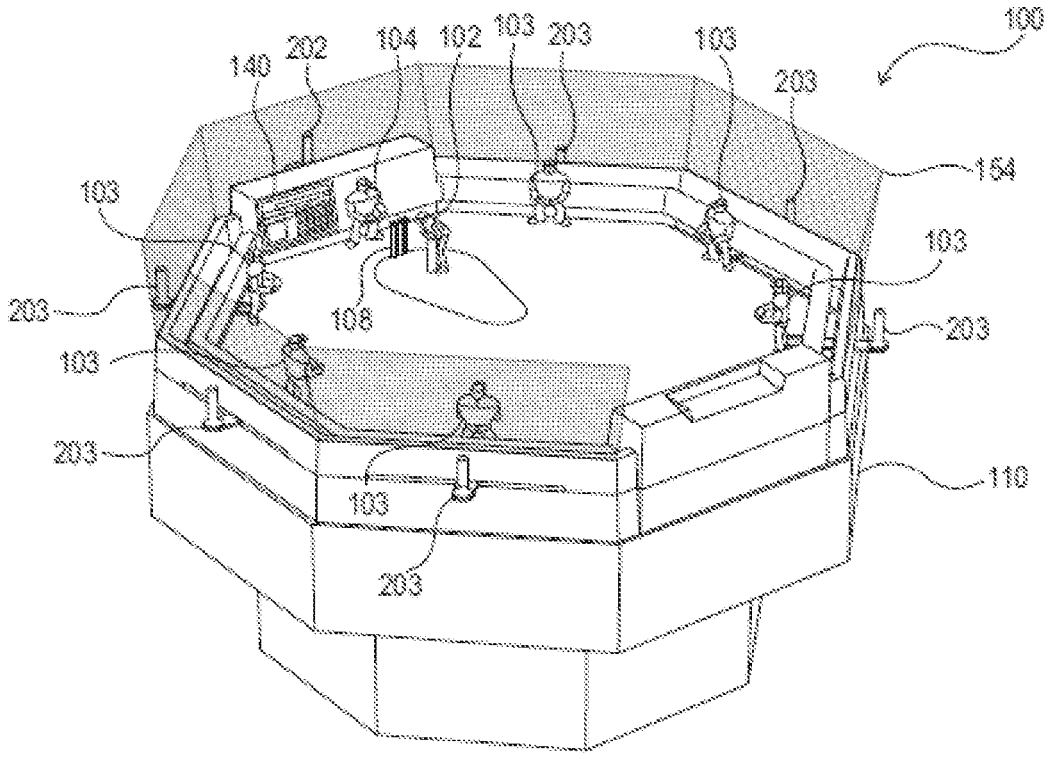
FIGS. 1A and 1B illustrate an exemplary cricket table game, according to one embodiment.

It should be noted that the figures are not necessarily drawn to scale and that elements of structures or functions are generally represented by reference numerals for illustrative purposes throughout the figures. It also should be noted that the figures are only intended to facilitate the description of the various embodiments described herein. The figures do not describe every aspect of the teachings described herein and do not limit the scope of the claims.

DETAILED DESCRIPTION

A mechanical ball launcher for a table game is disclosed. According to one embodiment, the mechanical ball launcher has a body that rotates about a first axis. The body has a launch arm that extends along a second axis that is substantially perpendicular to the first axis. The launch arm has a ball receptacle at a terminal end. The mechanical ball launcher has a supporting plate supporting the body and a mechanical spring connected between the body and the supporting plate. The mechanical spring is placed in a loaded position when the launch arm is pulled back. A launch angle, a lateral angle, and a speed of the ball are adjusted as the ball is launched from the ball receptacle of the mechanical ball launcher.

The ball launcher mechanism determines one or more attributes with which a ball is launched and is controlled by a first player. The ball striker mechanism controls a ball striker having a bat to hit a ball launched by the ball launcher mechanism and is controlled by a second player. The ball interceptor mechanisms or fielders are used to stop or catch balls that are hit by the ball striker mechanism, and may be controlled or positioned at various locations by additional players. The table game further comprises one or more sensors placed in predetermined locations in the playing field. The one or more sensors generate electrical signals upon detection of the ball in the predetermined locations in the playing field. Additional sensors may be located around the playing field. The table game further includes a control circuit board containing a microcontroller or microprocessor to receive and process the electrical signals from the one or more sensors. The electrical signals from the sensors on the game are routed, via a sensor printed circuit board (PCB) to a microcontroller PCB.

The microcontroller determines one or more events using the electrical signals provided by the one or more sensors and updates the status of the table game.

In one embodiment, the microcontroller PCB communicates, via a serial link (e.g., RS 232) or a wireless link (e.g., Wi-Fi), to a software application running on a personal computer running Windows 7 or XP.

In another embodiment, the microcontroller PCB communicates via a wireless link to an application running on a tablet PC running iOS or the Android operating system.

The software application determines the parameters of the game play such as the number of players and the type and length of a game, and updates the status of the game as events occur. In this embodiment, the intrinsic audio and video processing capabilities of the personal computer or tablet PC are used to provide real time feedback to the users on the status of the game.

In the following description, for purposes of clarity and conciseness of the description, not all of the numerous components shown in the schematic are described. The numerous components are shown in the drawings to provide a person of ordinary skill in the art a thorough enabling disclosure of the present invention. The operation of many of the components would be understood to one skilled in the art.

Each of the additional features and teachings disclosed herein can be utilized separately or in conjunction with other features and teachings to provide the present table game. Representative examples utilizing many of these additional features and teachings, both separately and in combination, are described in further detail with reference to the attached drawings. This detailed description is merely intended to teach a person of skill in the art further details for practicing preferred aspects of the present teachings and is not intended to limit the scope of the claims. Therefore, combinations of features disclosed in the following detailed description may not be necessary to practice the teachings in the broadest sense and are instead taught merely to describe particularly representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help understand how the present teachings are practiced but are not intended to limit the dimensions and the shapes shown in the examples.

The table game provides a realistic three-dimensional emulation of the game of cricket. According to one embodiment, a ball is launched into the air towards the batsman or ball striker, for example, approximately 6 inches above the playing field. The ball launcher mechanism (see FIGS. 4B and 4C) simulates a bowler of a real cricket game who typically throws a ball towards the batsman by keeping his arm straight and rotating it rapidly in a vertical plane, towards the batsman. The ball travels through the air over a significant portion of the playing surface, and usually reaches the batsman after one bounce or full toss. The bowler controls the speed, the launch angle, the lateral angle (direction to the left or right of the wicket) as well as the spin of the ball. The trajectory and bounce of the ball allows the batsman to experience a life-like ball delivery and hit the ball along or above the surface of the playing field. The batsman mechanism provides a hitting action closely resembling how the ball is hit in a real game of cricket wherein the bat is rotated rapidly in a vertical plane to hit the ball. Sensors detect the ball at various stages and locations and provide signals for determining events, such as scoring and outs. The events are announced via audio and visual mechanisms to the players creating a real multi-media game playing experience.

According to one embodiment, the table game disclosed herein is adapted to other ball games such as baseball or softball that require a pitcher (or a ball launcher) and a batter (or a ball striker). Alternatively, each of the ball launcher mechanism and the ball striker mechanism, individually or in combination, may be used in other ball games. For example, the ball striker mechanism may be used to strike a golf ball in a golf table game. It is appreciated that the presently described table game or individual part(s) of the table game may be applied to other ball games without deviating from the scope of the present subject matter.

Figure 1B:
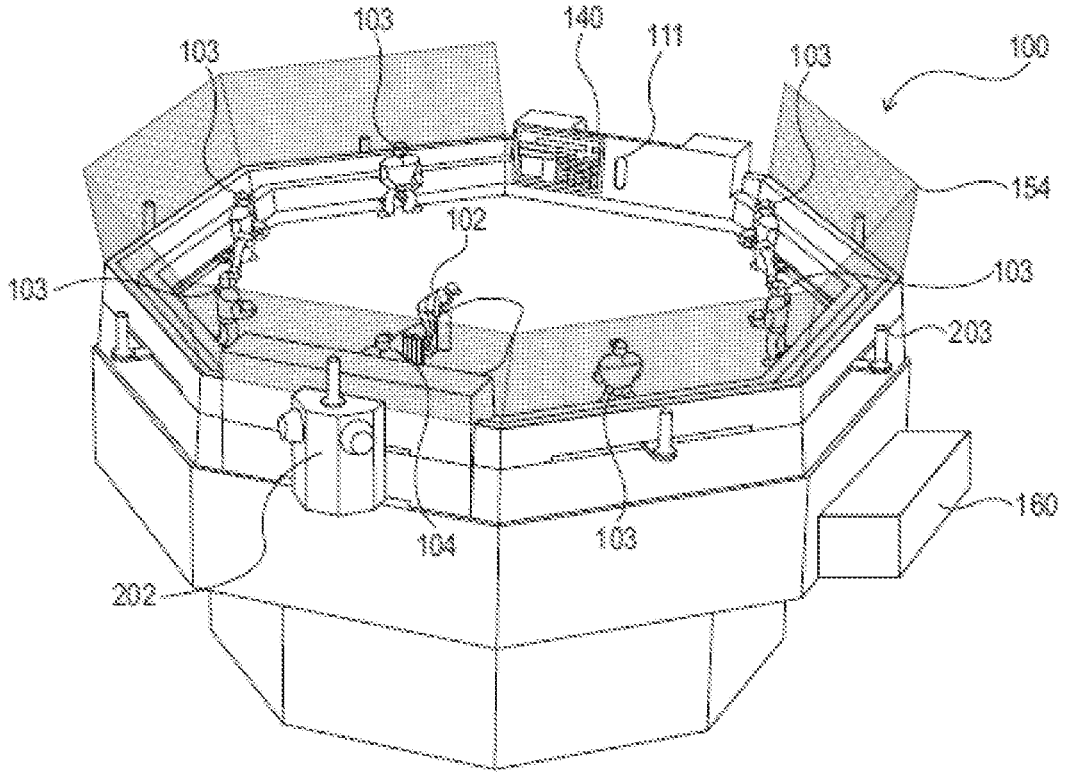

FIGS. 1A and 1B illustrate an exemplary cricket table game, according to one embodiment. A batsman 102 and one or more fielders 103 are positioned on a game table 110. A bowler is represented by a ball launcher mechanism 201 from which a ball is bowled or pitched. A ball 105 is launched from the ball launcher mechanism 201, and batsman 102 hits the launched ball 105. The fielders 103 catch or stop the hit ball 105 from reaching the boundary of the game table 110.

According to one embodiment, the cricket game 100 is played by two or more players simultaneously. Each player may take turns controlling the ball launcher mechanism 201, the batsman control 202, or one or more of the fielders 203. The game may be played between individuals or between teams of individuals.

The table game 100 provides realistic three-dimensional actions of a cricket game. A ball 105 is launched from the ball launcher mechanism 201 towards the batsman 102. The player controlling the ball launcher mechanism 201 can change the speed, trajectory, and spin of the ball 105 simultaneously and in real-time, just as the ball is about to be launched. The ball 105 following a trajectory in a three-dimensional space provides more reality and unpredictability in game play than a ball rolled on a surface of a table. The ball 105 may travel above the surface of the game table 110 or a significant portion thereof between the ball launcher mechanism 201 and the batsman 102 and/or bounce off the surface of game table 110. The player controlling the batsman 102 reacts quickly, defends the wicket 108, and hits the ball 105 in a manner that closely resembles a real cricket game, along or above the surface of the game table 110. The bowler tries to minimize runs scored by the batting team. The fielders 103 assist the bowler 102 in this effort by catching and/or fielding the hit ball 105. The batting team, including the batsman 102, tries to score as many runs as possible without getting out.

According to one embodiment, various sensors are employed in the table game. The sensors detect the motion and position of a ball, and a computer of the table game determines and updates the status of the game in response to the sensor's detection of the ball. The status of the game and scores are updated on display(s) 140 real time. A variety of sound effects may accompany visual indicators on the display (s) 140 to provide a realistic game playing experience.

In one embodiment, the sensors used to detect the presence of a ball are photosensitive sensors. Photosensitive detectors are used in the ball launcher mechanism 201 and the gutters 152 and 153. These photosensitive detectors include a light emitter diode (LED) and a photosensitive sensor that detects the blockage of light as an object passes between them. The collision of a ball with the wicket 108 or the lower body of the batsman 102 is detected by mechanical or electromechanical switches such as tactile switches. It is appreciated that various types of sensor mechanisms such as capacitive sensors, contact sensors, proximity sensors, motion sensors, and accelerometers may be used without deviating from the scope of the present subject matter.

Figure 2:
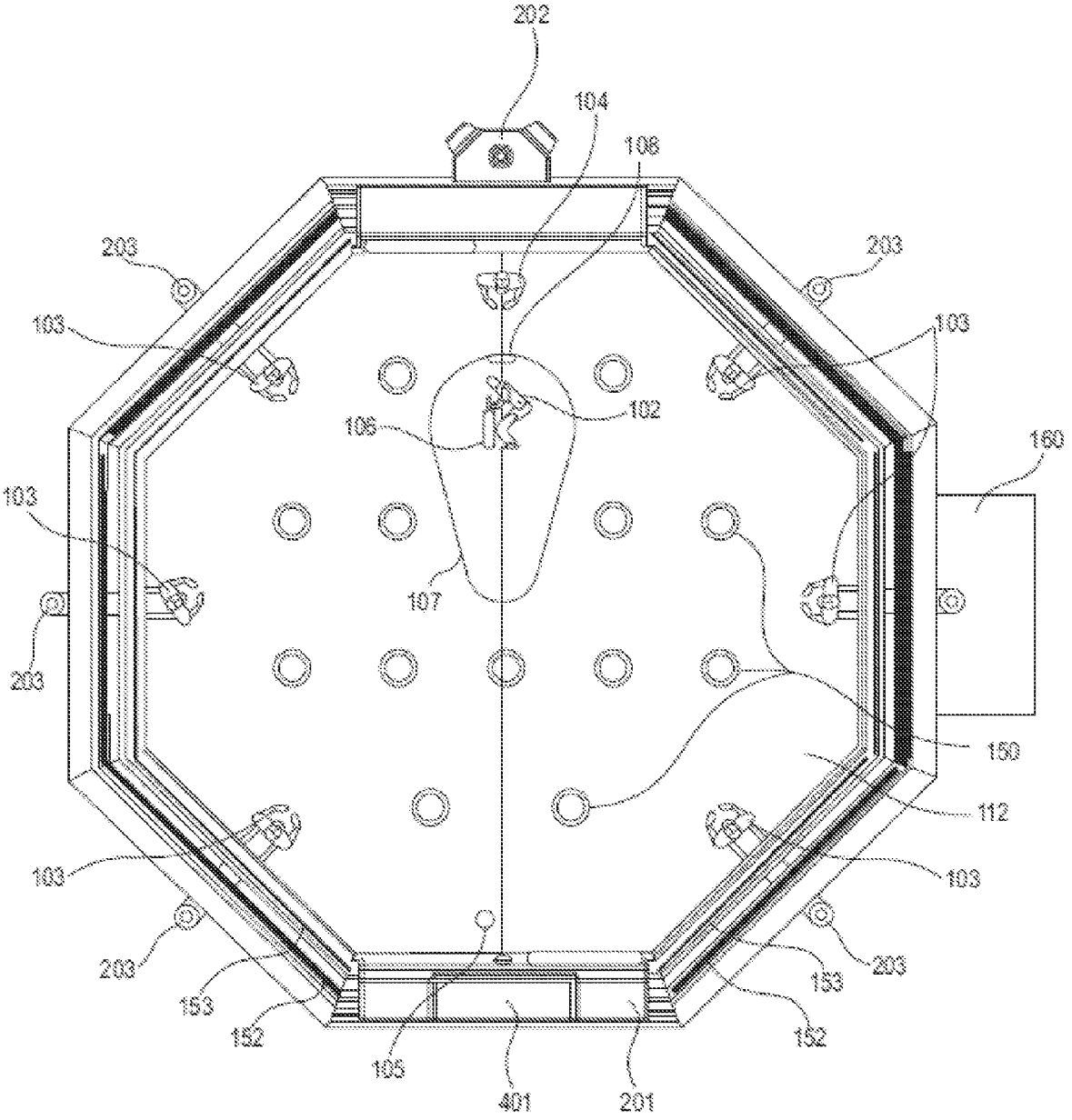
FIG. 2 illustrates the top view of an exemplary cricket table game, according to one embodiment.

FIG. 2 illustrates the top view of an exemplary cricket table game, according to one embodiment. Referring to the exemplary cricket table game illustrated in FIG. 10, on the playing field of the game table is an area 107 called a "pitch." The pitch 107 refers to the region on the playing field around the batsman 102 where a launched ball generally bounces. According to one embodiment, the surface of the pitch 107 is made of a material having a texture and rigidity to allow the ball 105 to bounce as in a real cricket game. For example, the pitch surface is covered with a material to provide variation and unpredictability on the bounce of the ball. The pitch 107 may be of any shape, for example, a rectangle, an ellipse, or a circle. The inner part of the playing field surrounding the pitch is an infield, and the outer area 112 surrounding the infield and extending to the boundary of the field is an outfield.

According to one embodiment, the playing surface may be a part of a customized table. Alternatively, the playing surface may be removable and foldable so it can be placed on an existing table of a comparable size. According to another embodiment, the table game is provided with a playing surface and the necessary components configured for placement atop an existing table or platform. According to yet another embodiment, the ball launcher mechanism, ball striker mechanism, and/or other components of the table game are provided separately and are assembled onto or on the perimeter of the playing surface to provide the table game.

The surface of game table 110 may be covered with a green felt, carpet or similar suitable material that simulates a real playing field or lawn. The material may be carefully selected to allow for a given amount of bounce and control on a ball 105. It is appreciated that a variety of materials, textures, shapes, and colors may be used for covering the playing field of the game table 110 to achieve functional and/or aesthetic purposes. In one embodiment a green outdoor carpet is used to cover the playing surface. In another embodiment, the playing field is made of medium density fiberboard (MDF) painted and marked for aesthetic purposes. In another embodiment, the playing field is made of a plywood painted and marked for aesthetic purposes.

The player using the ball launcher mechanism 201 launches a ball 105 with certain attributes, such as speed, launch angle (up or down with respect to a horizontal plane), spin and lateral angle (left or right) towards the batsman 102. The player may manipulate the ball launcher mechanism 201 to change these attributes simultaneously and on the fly, and from one ball delivery to the next, providing elements of surprise and unpredictability in a game play. The ball 105 may reach the batsman 102 without bouncing or after bouncing on the pitch 107. Also, the ball launcher mechanism 201 allows the player to give a desired amount of spin to the ball 105, such that the ball 105 deviates toward the left or right relative to the wicket 108 to confuse the batsman 102. Enabling a spin on ball 105 adds another level of resemblance to a real cricket game where spin bowling is commonly used.

According to one embodiment, the ball launcher mechanism 201 is an electromechanical device containing two wheels 455 driven by motors 453 that are controlled by microcontroller to launch the ball 105 in a precise manner with the above mentioned desired attributes. The allowable ranges of each degree of freedom of the ball 105 may be programmed into the microcontroller.

The player controlling the ball launcher mechanism 201 selects desired attributes of the ball trajectory via a ball launcher user interface 401. According to one embodiment, the attributes of the ball 105 are independently specified, for example, spin, speed, direction, and launch angle. Alternatively, the player may be given an option to randomize the attributes of the ball 105 to such a degree that the ball launcher mechanism 201 automatically determines the type of ball delivery within an acceptable range of possibilities. Controlling the trajectory of a ball 105 accurately and repeatably with a number of variations is essential for game play. Simplifying bowling by allowing a player to select a ball trajectory without calculating the launch angle and launch speed for specific trajectory is essential for ease of use of the ball launcher mechanism 201. The selection of ball attributes via the ball launcher user interface 401 is sent to a microcontroller to calculate the speed and launch angle of a ball and to provide appropriate electrical signals to the motors and/or actuators. According to one embodiment, a feedback mechanism is incorporated in the ball launcher mechanism 201 to achieve and maintain accuracy of the motor speed over a long period of time.

According to one embodiment, the launch angle of the ball launcher mechanism 201 is manually controlled. Alternatively, it can be controlled by a stepper or DC motor via an appropriate gear mechanism. Similarly, the direction of the ball launch (left or right) relative to the wicket may be controlled manually or by an electromechanical mechanism.

The ball launcher user interface 401 generates appropriate commands to launch a ball 105. The ball 105 is fed into the ball launcher mechanism 201 via an automatic or manual feeder mechanism (not shown) via the ball feeder tube 454. The feeder mechanism may be programmed to continuously provide balls 105 for batting practice or a game play. The ball launcher mechanism 201 decodes the player's inputs from the ball launcher user interface 401 and generates appropriate commands to launch the ball 105. According to one embodiment, the microcontroller of the ball launcher mechanism 201 enables it to automate and/or randomize a series of ball launches.

According to one embodiment, batsman 102 is mechanically controlled. The size of the bat 106 of the batsman 102 may be determined proportionally to the dimension of game table 110 or other players and/or the equipment of the other players. According to one embodiment, the batsman 102 stands 6 inches tall, and the bat 106 is 3 inches long and 0.5 inches wide. The batsman 102 is controlled by the batsman control 202. The design and functionality of the batsman control 202 is two-handed and ambidextrous, and intuitive to provide the player with a sense that he/she is actually manipulating a bat in a real cricket game. The batsman control 202 enables the player to move the batsman 102 rapidly in the game with three degrees of motion: (1) the batsman 102 and bat 106 can rotate about an axis that runs vertically through the batsman 102; (2) the batsman 102 can translate left and right to cover the width of the pitch; and (3) the bat 106 swings about a horizontal axis to strike a ball 105.

According to one embodiment, each of the fielders 103 is mechanically or electromechanically controlled. One player may control one or more fielders 103 via a coupling mechanism connecting the one or more fielders 103. The fielding team may strategically place the fielders 103 to catch or stop a hit ball 105 so that runs awarded to the batting team are minimized. A fielder 103 can move left and right within the confinement of the fielder control 203 to cover the entire section or a portion of each octagon segment of game table 110. The numbers of fielders 103 may vary depending on the size and shape of game table 110. To add reality to the game, fielders 103 resemble a real player, and their dimensions are chosen to provide a cross-sectional area that can stop or catch hit balls 105 by the batsman 102. In another embodiment, fielders 103 are not controlled in real time, but may be placed at appropriate locations on the field before the next ball is launched.

According to one embodiment, one or more drains 150 are provided on the surface of the table and a gutter 153 is provided alongside the perimeter of the game table 110. An additional gutter 152 is located outside of gutter 153. A barrier also referred to as a boundary wall 155 separates the inner gutter from the outer gutter. The balls that are played are collected through the drains 150 or gutter 152 or 153 to continue the table game without human interference. Sensors detect the presence of a ball as it falls into any of the drains or gutters.

According to one embodiment, there are two gutters 152 and 153 to detect and collect balls. The boundary wall 155 directs balls that are hit towards the perimeter of the playing field into the gutter 153. Any ball 105 that is hit along the field and reaches the boundary wall 155 after one or more bounces falls into gutter 153 and gets the batsman 0, 1, 2, 3 or 4 runs, per the Scoring Table. A ball 105 that flies over the boundary wall 155 without a bounce is caught by net 154, enters the gutter 152, and scores six runs. Net 154 may be replaced or supplemented with other types of barriers to catch the balls flying over the boundary wall 155. The ball sensors in gutter 152 and 153 sense the ball 105 and provides an electronic signal to the main computer 160, via the on-board microcontroller. The program of the main computer 160 interprets the electronic signal as an event, provides audio and visual feedback on the event, and updates the scoreboard accordingly.

According to one embodiment, scoring is both timing and location based. A timer is started the moment the player of the ball launcher mechanism 201 launches a ball. If the ball makes its way into the gutters 152 and 153 within a specified time interval the batsman scores runs, however if the ball does not make it to the gutters 152 and 153 before the timer has expired then no run is scored. The inner gutter 153 and outer gutter 152 are divided into discrete segments along their circumference. Each segment of the gutter 152 and 153 has a ball detection sensor. A timing-based Scoring Table is used by the microcontroller and/or the computer to determine how many runs (points) to award to the batsman based on the gutter segment (i.e., distance from the batsman) and the time taken for ball to fall through the gutter segment. Balls that are hit harder and make their way to the gutters faster generally result in more runs, than balls that make their way to the gutter more slowly. The timing-based scoring is intuitive and provides a natural incentive for the batsman 102 to try to hit balls directly into open gutters and avoid fielders. The scoring look-up table may be modified to make it easier or harder score and adapt games to varying skill levels.

In one embodiment fielders 103 do not contain any sensors but are designed with an upper body cavity to retain (catch) the balls that are hit into their upper body area. The ball 105 that impacts a fielder 103 may bounce off the fielder 103 and then fall into the boundary gutters 153 or 152 or any of the other drains 150 on the surface of the playing field, or fall into and be retained by the upper body cavity of the fielder 103. According to one embodiment, 4 user buttons (switches) 1101 are added to the corners of the game. Two identical switches at the bowler end are used by the bowler or a fielder to register a "Caught Out" event when a ball is caught by a fielder 103. This typically happens when the batsman 102 hits the ball into a fielder 103, and the ball is retained inside the fielder 103. In the event when the ball bounces off a fielder and falls into one of the gutters or drains, the batsman is awarded an appropriate number of runs based on the timing-based Scoring Table. According to one embodiment, the fielders 103 may be made of an absorbent foam-like material to minimize bounce-backs from the fielder 103 and to increase the likelihood of getting the batsman out caught.

According to one embodiment, the game table 110 is a rectangular with rounded corners. The shape and/or dimensions of the game table 110 may vary depending on system configuration, complexity, the numbers of players, and/or similar factors. The batsman 102 is placed approximately 34 inches away from the ball launcher mechanism 201. The length and width of the playing field is approx. 34 inches and 26 inches respectively. According to one embodiment, the surface of the field is gradually down sloped toward the outfield 112 to provide a passive ball recovery mechanism. A played ball 105 rolls towards and falls into one of the drains or gutters and is returned towards the ball launcher mechanism 201. The ball that does not fall into one of the drains 150 or gutters 152 and 153 is manually removed from the playing field before the next play.

When a ball 105 is bowled, the game 100 is in play. The sensors placed in the ball launcher mechanism 201 detect the launch of the ball 105, the speed of the ball, and/or other information. The information is displayed or updated on the display(s) 140. The batsman 102 may choose to play the ball 105 or pass it. If the batsman 102 passes the ball, no run is scored. If the ball 105 hits the wicket 108 positioned behind the batsman 102, the batsman 102 is out. The sensor placed in the wicket 108 detects if the batsman 102 is bowled out. This information is updated on display 140 optionally, along with associated audio or video effects.

There are multiple ways of getting the batsman 102 out. First, when a launched ball 105 hits the wicket 108 either directly or after touching any part of the batsman 102 or bat 106, the batsman 102 is called out. If a ball 105 hit by the batsman 102 with the bat 106 or a launched ball that hits the upper body of the batsman 102 is subsequently caught by any fielders 103, the batsman 102 is also called out. The batsman 102 is also out if the ball 105 hits the batsman 102's lower body while the lower body is in front of the wicket 108. One or more small mechanical switches are placed in the leg of the batsman 102 to detect ball collisions with its lower body, according to one embodiment. An optical sensor detects the position of the batsman left or right relative to the wicket.

For each ball 105 being bowled and played, batsman 102 may score 0, 1, 2, 3, 4, or 6 points or runs. According to one embodiment, runs are counted and scored only within a predefined period (e.g., 3 seconds) after the ball is launched. During this time period, the ball is said to be in play. After the predefined period has elapsed, the play is considered to be over, and no runs are scored.

According to one embodiment, one or more drains 150 are marked with a number that is placed on the field or the fence of the game table 110. If a hit ball 105 lands on one of these drains 150 and falls into the corresponding drains 150, the batsman 102 scores the run(s) marked on the drain 150. Each drain 150 is equipped with a sensor to detect the ball 105 that falls into it, and provide an electronic signal to the main computer 160 of the cricket game 100.

The main computer 160 may be a dedicated processor with adequate memory and processing power to provide video and audio outputs and to read and record signals from the sensors. The main computer 160 may be an existing desktop or laptop computer that communicates in real time with a microcontroller circuit. According to one embodiment, the main computer connects and downloads game scores and results to a data server allowing players to compare their scores against other players.

In one embodiment, a PIC microcontroller unit located on the table communicates with a Windows 7 based laptop. In another embodiment, a Rabbit RCM5600W microcontroller is used to communicate with an iPad or an Android tablet PC. An application running on the iPad or the tablet PC communicates with and displays and updates scores as events occur on the playing field.

Scores are updated automatically by the main computer 160 of the cricket game 100 using inputs from the various sensors and a timer that determines when the ball is in play. Runs may be scored when the ball falls into one of the gutters or the scoring drains within a specified amount of time as determined by the Scoring Table. Any events detected after the expiration of the timer do not result in runs or outs.

Figure 3:
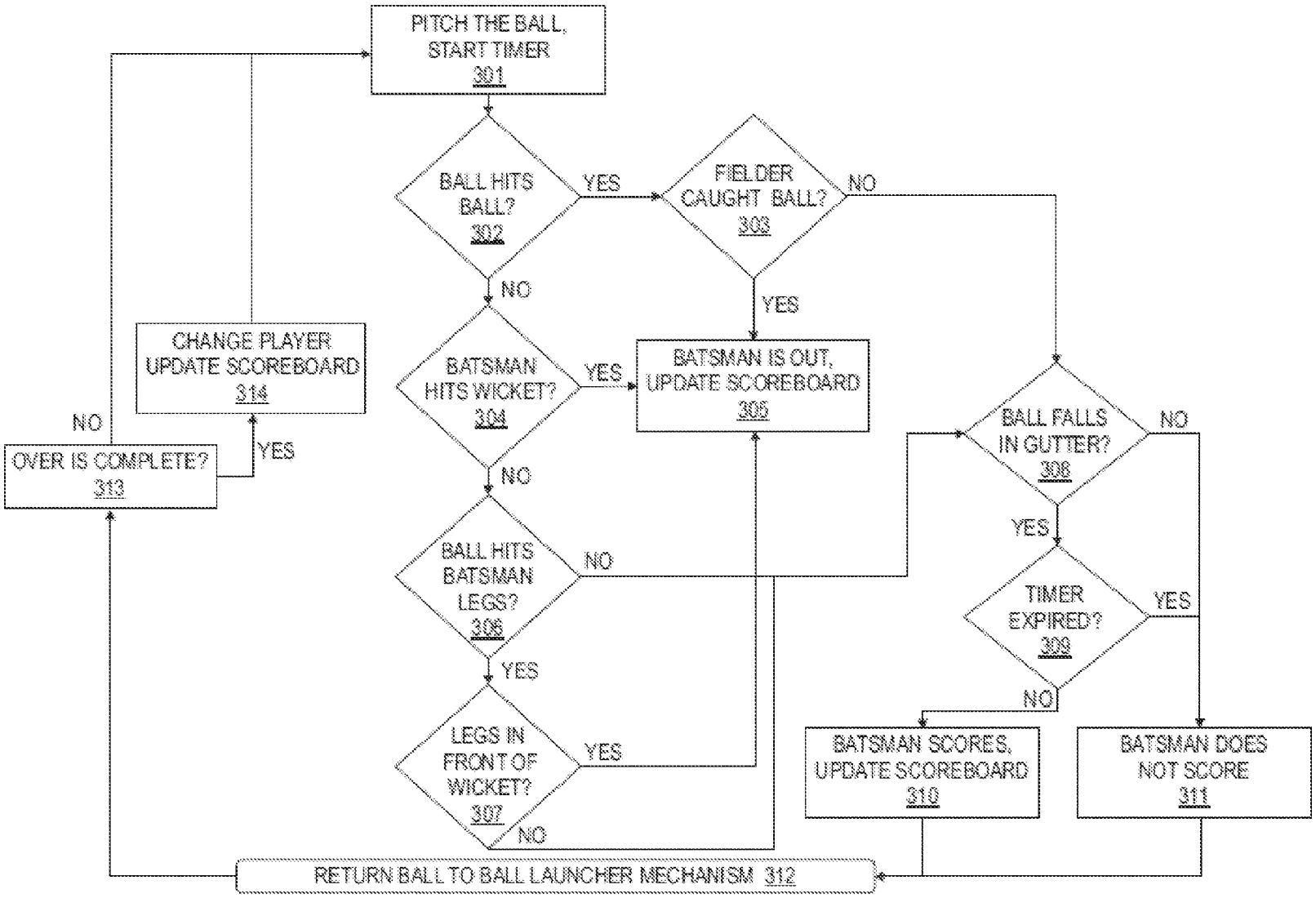
FIG. 3 illustrates an exemplary flow chart for an exemplary cricket game, according to one embodiment.

FIG. 3 illustrates an exemplary flow chart for an exemplary cricket game, according to one embodiment. The bowler selects the input parameters (e.g., speed, launch angle, spin) to change the control of a ball 105 being launched (301). The ball 105 is launched and the timer is started (301). The batsman 102 either hits the ball 105 or, intentionally or unintentionally misses the ball 105. If the ball 105 is not hit by the batsman 102's bat 106 but hits the wicket 108 instead (304), the batsman 102 is called out, and the status is updated (305). After the batsman 102 hits the ball 105 using the bat 106 (302), and the ball is caught by one of the fielders 103 or the wicketkeeper 104 the batsman is called out (303). If the hit ball 105 is not caught by any of the fielders 103 but falls into one of the drains 150, or gutters 152 or 153 (308), and the timer has not expired (309), the batsman scores the number of runs associated with the drain 150 or gutter 152 or 153 (310). If the timer has expired, or the ball does not fall into one of the drains 150 or gutters 152 or 153, the batsman does not score any runs (311).

If the ball hits the batsman 102's legs or lower body (306) and the legs (or lower body) are in front of the wicket (307), the batsman 102 is called out (305). If the ball does not hit the batsman 102's legs or lower body, or the legs and lower body are not in front of the wicket, the batsman is not out. If the ball subsequently falls into one of the drains 150, or gutters 152 or 153 (308), and the timer has not expired (309), the batsman 102 scores the number of runs associated with the drains 150 or gutters 152 or 153 (310). If the timer has expired or the ball does not fall into one of the drains 150 or gutters 152 or 153, the batsman 102 does not score any runs (311).

After a ball 105 is launched, there are three possible outcomes: (1) the batsman 102 is called out, (2) the batsman 102 is not out, but scores runs, and (3) the batsman 102 is not out and does not score any runs. Following any one of the above three outcomes, the ball 102 is considered to be dead or no longer in play. The ball 105 is returned to the bowler (309) through the drains and gutters. In alternative embodiments, additional outcomes are possible.

Figure 4A:
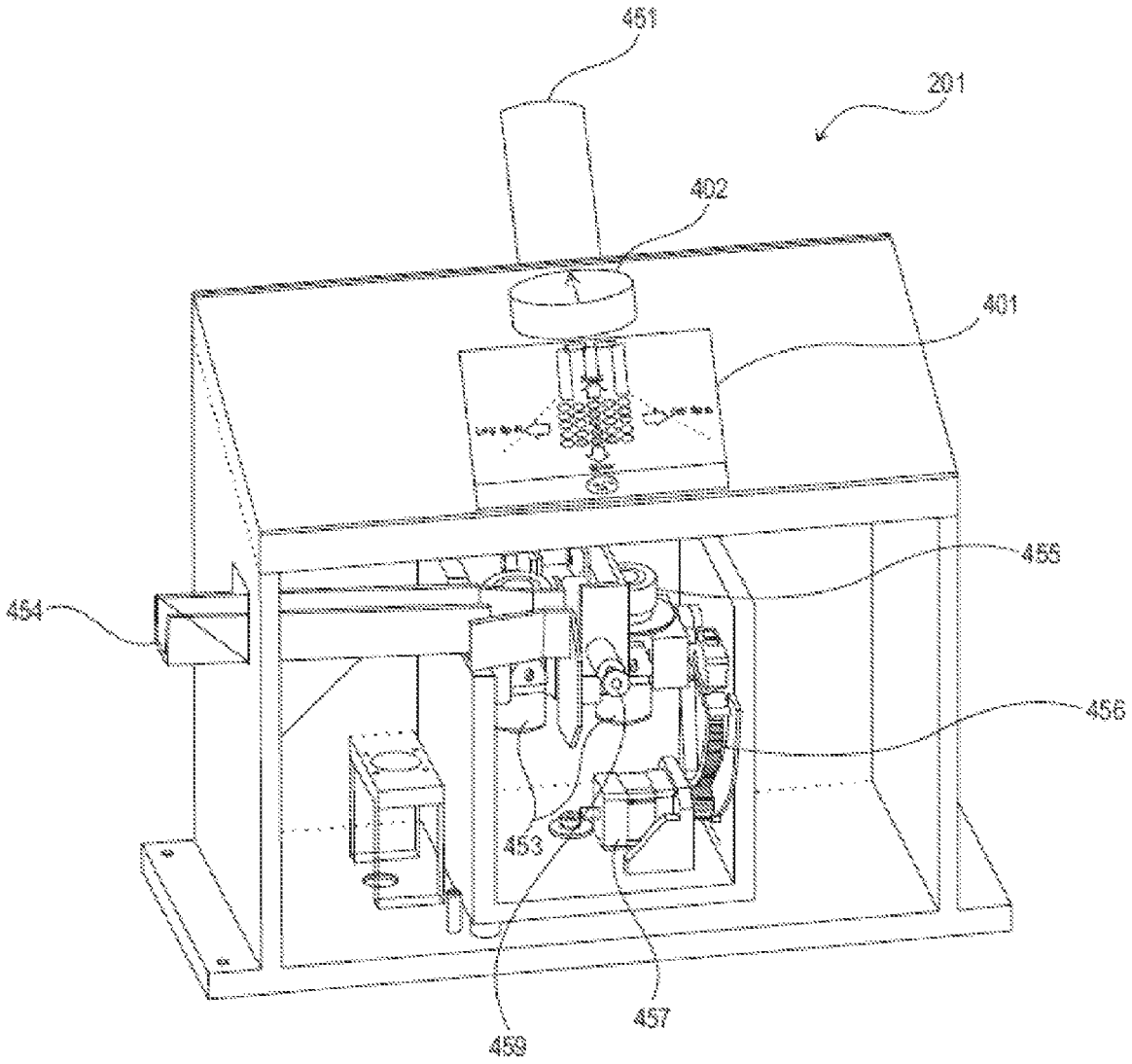
FIG. 4A illustrates an exemplary ball launcher mechanism, according to one embodiment.

FIG. 4A illustrates an exemplary ball launcher mechanism, according to one embodiment. The ball launcher mechanism 201 is attached to a side of the game table 100 designated for the bowler. The ball launcher mechanism 201 contains a ball feeder tube 454, a ball guide 458, wheels 455 attached to motors 453, a ball chute 451, and a solenoid 459. The wheels 455, motors 453 and ball chute 451 are collectively referred to as a launch assembly. The manually or automatically recovered balls 105 are fed to the ball launcher mechanism 201 through the ball feeder 454 one at a time. The ball is stored in the ball guide 458 until the player decides to launch the ball via the ball launcher user interface 401. Upon the player's input for launching a ball, a ball is positioned in front of the solenoid 459, and the ball is pushed by the solenoid 459 between the wheels 455 to propel the ball. In another embodiment, the ball is fed by gravity to the wheels 455. The launch angle of the ball 105 is adjusted manually or automatically by moving the launch assembly via a stepper or DC motor 457 coupled to the gear 456. The ball chute 451 may be hidden behind the slot 111 so that the batsman 102 is unable to predict the trajectory of the ball 105 when launched.

According to one embodiment, the outer surface of wheels 455 is made of a soft and/or compressible material to ease insertion of a ball therebetween and to impart spin on the ball. To impart force to a ball having a diameter of 0.75 inch, the wheels 455 are placed with a gap of approximately 0.625 inch that is narrower than the diameter of the ball. In one example, the wheels 455 are Lite Flite wheels made of foam rubber manufactured by Dave Brown Products, Inc. of Hamilton, Ohio. To impart a desired propelling and spinning property, the surface of the wheels 455 may be covered with appropriate material.

For a specified type and size of wheels 455 and ball 105, the speed of the ball 105 at launch is determined by the speed of the spinning wheels 455 coupled to the motors 453. In the present example, two motors are used to propel the ball 105 but additional motors may be added to supplement the control of the ball attributes. In one embodiment, the motors 453 are DC motors rated at approximately 5000 RPM. The speed of the motors 453 may be controlled by a microcontroller circuit using pulse width modulation (PWM). Alternatively, the motors 453 may be stepper or servo motors. Other launching mechanisms may also be used by replacing motors 453, or using the motors 453 in combination with other types of electronic and/or mechanical launching mechanisms, to change the attributes of the ball 105's trajectory.

The computer 160 may individually control the speed of the motors 453 so that a spin can be applied to the ball 105. The bigger the differential of the speed between the two motors 453, the more spin is applied to the ball 105. In one embodiment, the maximum spin is selected such that the ball moves approximately 4 inches left-to-right, as viewed by the bowler, after bouncing on the pitch 107. The amount of spin is determined to allow the player controlling the batsman 102 experience a realistic cricket game. The relative position and/or the gap between the motors 453 may be additionally controlled to change the attributes of spin applied to the ball 105. For example, a forward spin may be applied instead of a side spin by placing the two motors up and down instead of side by side as shown in FIG. 4A. The surface of the wheels 455 may be treated or coated with different materials to change the attributes of the spin. Alternatively, the ball launcher mechanism 201 may employ a hydraulically-controlled or pneumatically-controlled launch mechanism or a simple mechanical launch mechanism instead of the electromechanically controlled mechanism shown in FIG. 4A. It is appreciated that the exemplary ball launcher mechanism 201 illustrated in FIG. 4A is not considered to limit the present subject matter, and various launching mechanisms can be employed without deviating from the scope of the present subject matter.

Figure 4B:
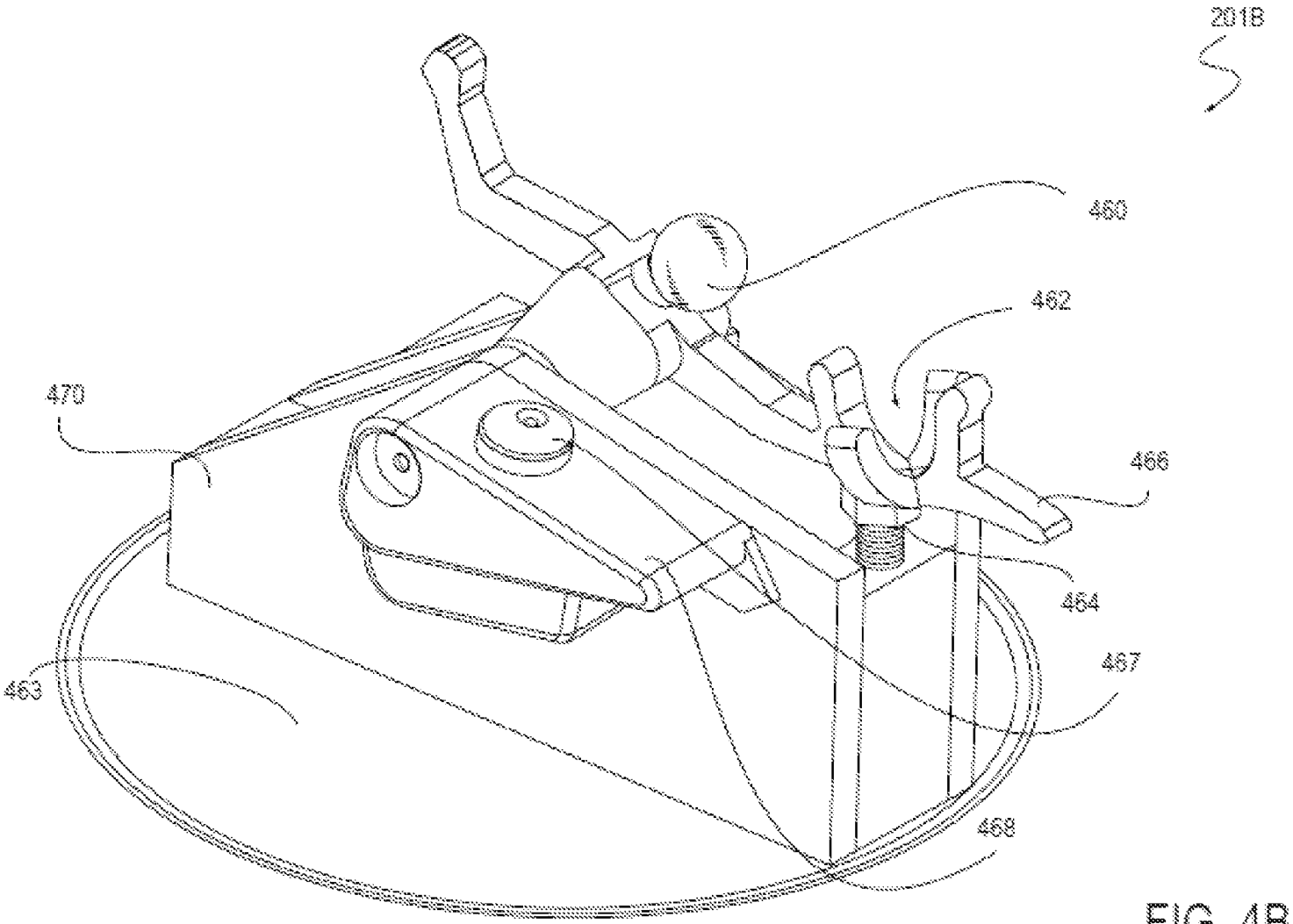
FIGS. 4B and 4C illustrate an alternative exemplary ball launcher mechanism, according to one embodiment.
Figure 4C:
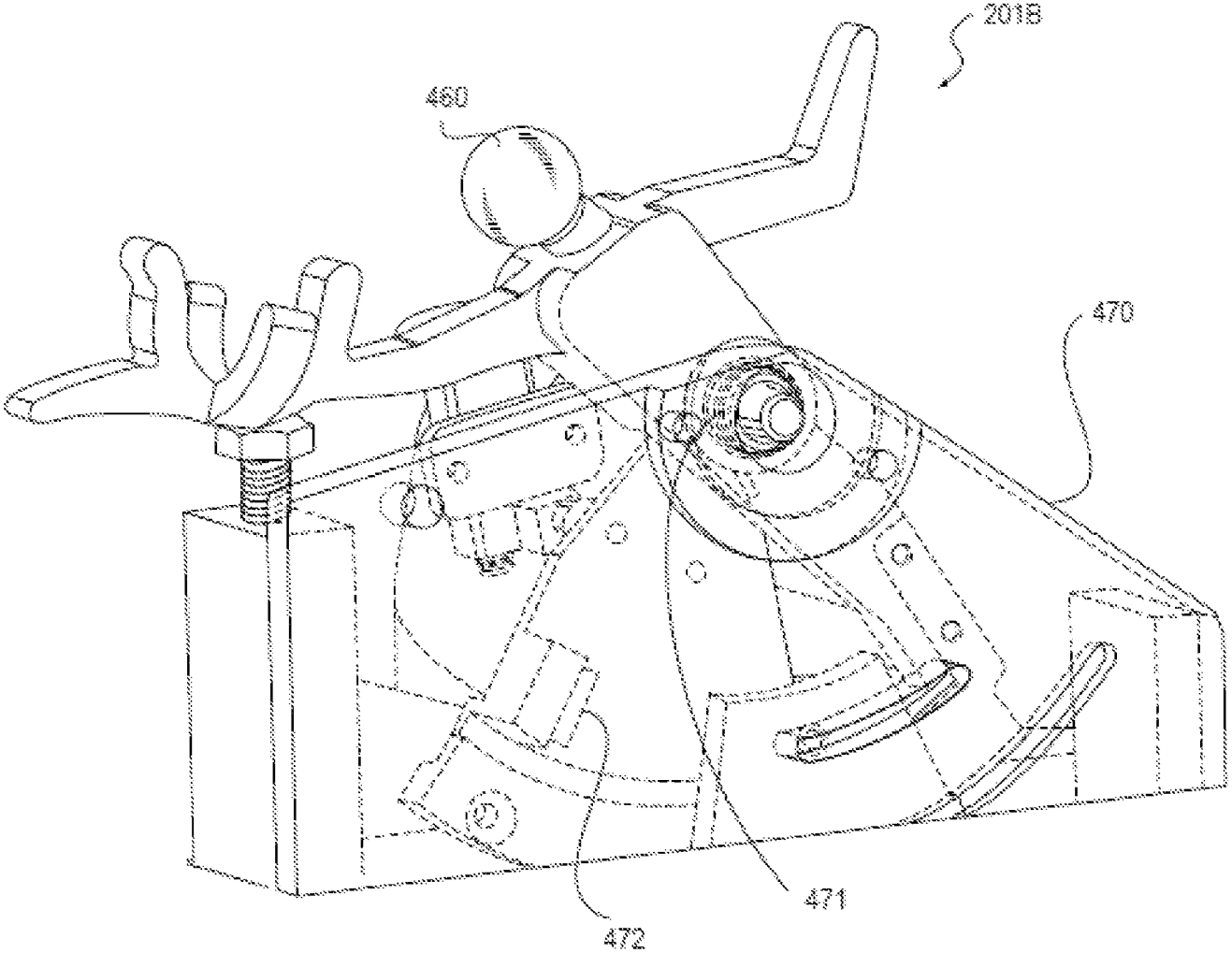

FIGS. 4B and 4C illustrate an alternative exemplary ball launcher mechanism, according to one embodiment. The ball launcher mechanism 201B is a mechanical spring-loaded device that resembles a human bowler or pitcher 460. The rearward arm of the pitcher 460 ends in a ball receptacle 462 resembling the hand of a human pitcher, into which the ball is placed for launching. The receptacle 462 has launch finger 466 that is used to pull the pitcher 460 back to the cocked position. The body of the pitcher 460 is supported with a horizontal shaft between two bearing plates 470. A mechanical spring 471 wound about the shaft is energized when the pitcher 460 is pulled back. According to one embodiment, the mechanical spring 471 is a torsional spring. In another embodiment, the mechanical spring 471 can be replaced with a linear spring without deviating from the scope of the present subject matter. An adjustable mechanical stop 472 or bumper determines the end-point of rotation of the pitcher 460. The launch angle knob 468 is connected to the mechanical stop 472. The position of the mechanical stop 472 can be changed moving the launch angle knob 468 to the desired launch angle. By adjusting the launch angle knob 468, the user can control the elevation angle at which the ball is released. The pull-back angle of the pitcher 460 determines the speed with which a ball is thrown. There is a range of minimum and maximum pull-back angle that is desirable for normal game play. The maximum pull back angle is determined by placing an adjustable mechanical pull-back limiter 464.

Figure 4D:
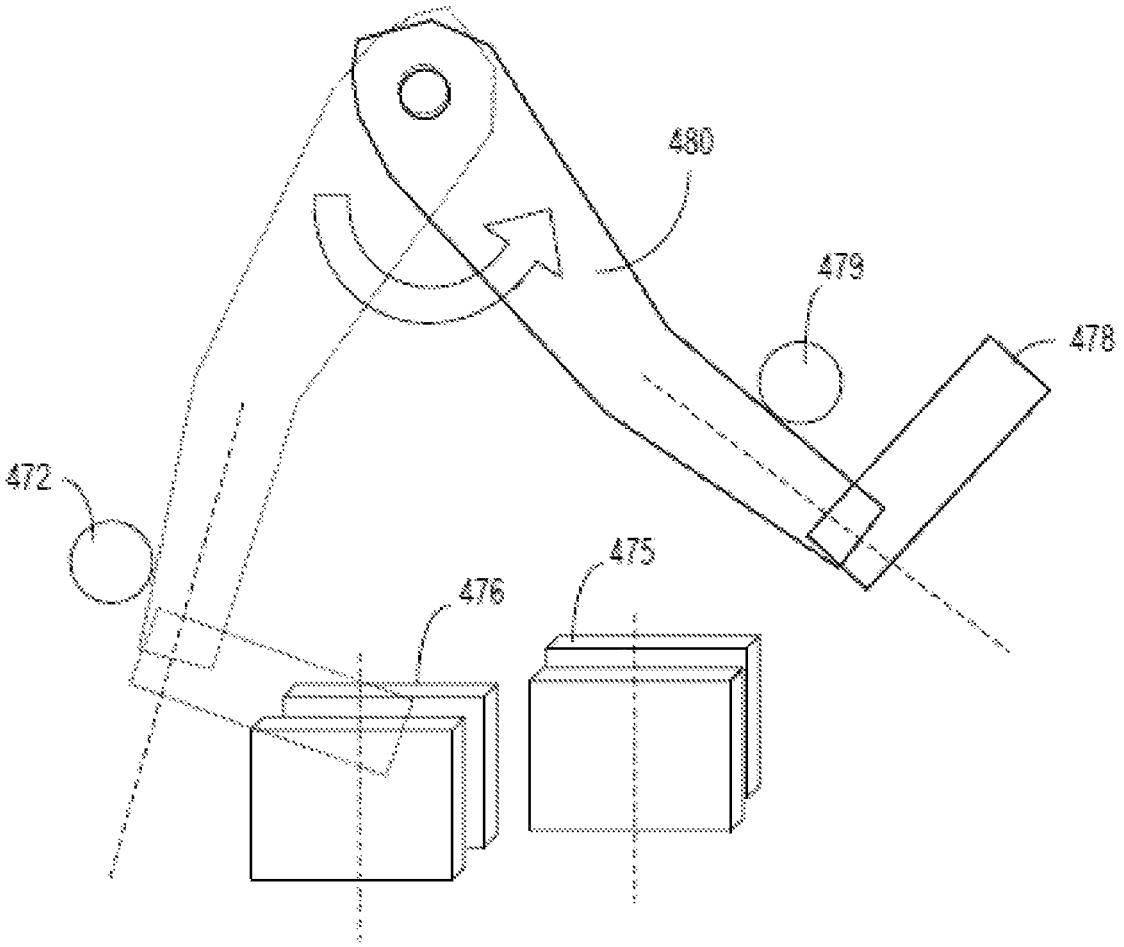
FIG. 4D illustrate optical sensors placed at the base of the pitcher, according to one embodiment.

FIG. 4D illustrate optical sensors placed at the base of the pitcher, according to one embodiment. Optical sensors 475 and 496 determine the status of the pitcher 460, for example, whether the pitcher 460 is pulled back far enough and when the pitcher is released. A sensor flag 478 attached to the leg 480 of the pitcher 460 pass through the slot of the optical sensors 475 and 476 to trigger electrical signals to determine the status of the pitcher 460.

The pitcher 460 is in contact with the bumper 479 in the unloaded position. As the pitcher 460 is pulled back in the loaded position, the sensor flag 478 obstructs the optical sensors 475 and 476 in sequence. If only the sensor 475 is obstructed, the pitcher 460 is not pulled back far enough, and the bowler must throw another ball. In the loaded position, sensor 476 is obstructed, and an LED light connected to the output from the sensor 476 is lit to indicate the bowler that the ball is ready to launch. When the pitcher 460 is released, the pitcher 460 rapidly returns to the unloaded position, tripping the optical sensors 475 and 476 in the reverse order, and stops against the bumper 479. The electrical signals output from the optical sensors 475 and 476 are sent to the microcontroller. The microcontroller determines a valid ball launch from the received electrical signals and starts the game timer accordingly.

A ball is inserted into the ball receptacle 462, and the pitcher 460 is pulled back and released. As the pitcher 460 rotates back towards its original position, a mechanical stop 472 is encountered that rapidly stops the rotation of the pitcher 460. This rapid deceleration results in the ball getting thrown out of the ball receptacle 462 of the pitcher 460 into the air, towards the batsman. The position of the mechanical stop 472 can be changed to adjust the launch angle, i.e., angle with respect to the horizontal plane, at which the ball is thrown out of the hand. The ball launcher mechanism 201B is located on a circular turntable 463 that can be rotated about a vertical axis. Rotation of the ball launcher mechanism 201B about the vertical axis allows a player to change lateral angle, or the direction of the ball towards the left or the right of the wicket 108. The hand of the pitcher 460 is designed in a way that allows a player to impart a spin on the ball as it leaves the ball receptacle 462. For example, the player imparts a spin on the ball by using the index finger to gradually trail off the surface of the ball as the ball is released from the ball launcher mechanism 201B. The direction in which the index finger trails off the surface of the ball is the direction of the spin.

According to a second embodiment, the player controlling the ball launcher mechanism 201B can change the launch angle (measured with respect to the horizontal plane) by moving the location of the mechanical stop 472. In one embodiment, the range of motion of the mechanical stop 472 is selected so that the launch angle of the ball is constrained within 10-40 degrees. The speed of the ball is controlled by adjusting the degree of pullback angle of the bowler or pitcher 460. The lateral direction of the launch can easily be changed by rotating the turntable 463 towards the left or right about a vertical axis.

It is noted that the mechanical launcher turntable 463 may be implemented with the electronic ball launcher mechanism 201. The electronic ball launcher mechanism 201 allows the possibility of automation and single player mode.

Figure 5:
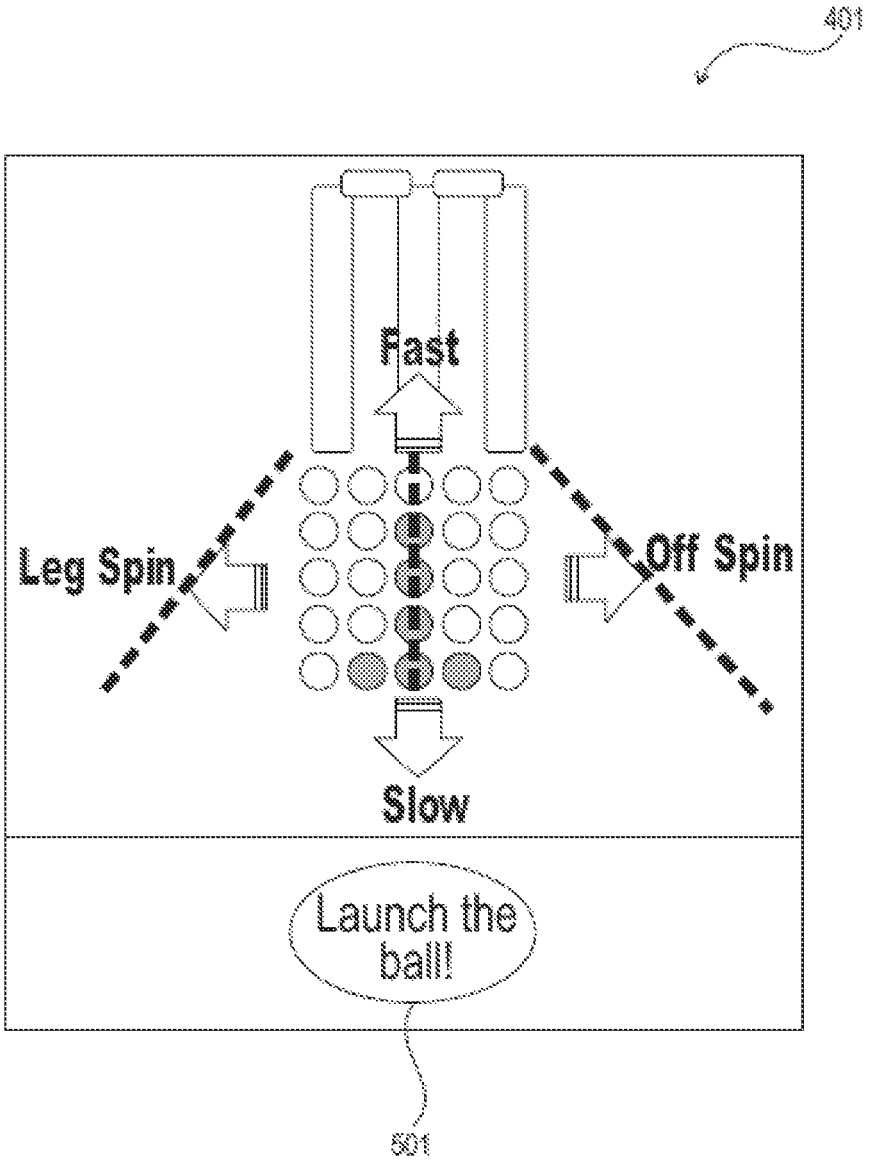
FIG. 5 illustrates an exemplary graphical user interface for a ball launcher mechanism, according to one embodiment.

FIG. 5 illustrates an exemplary graphical user interface (GUI) for a ball launcher mechanism, according to one embodiment. The ball launcher user interface 401 allows the player to select attributes, such as desired speed and spin of a launched ball 105. According to one embodiment, the ball launcher user interface 401 is coupled with a joystick 402 or a touch screen to control inputs for the ball launcher mechanism 201. In the present example, the four arrows and 25 dots signify the range of speed and spin to choose from. The default speed is initially shown on the display, and it is adjusted by using the up (fast) and down (slow) arrows. The magnitude as well as the direction of spin may be selected and applied using the left and right arrows. When the appropriate parameters have been selected, the launch button 501 is pressed to launch a ball 105. The direction of the ball to the left or right of the wicket 108 may be adjusted manually using the control knob 402 or electronically using another DC or stepper motor (not shown).

The selections made on the ball launcher user interface 401 are transmitted to a control circuit. Based on selections, the control circuit calculates the speed and launch angle of a ball 105 and sends appropriate electrical signals to the control board controlling the speed of the motors 463 and the elevation control of the chute 451. In one embodiment, the control circuit of the ball launcher mechanism 201 includes an 8-bit CMOS, Flash-based PIC microcontroller from Microchip Technology, Inc of Chandler, Ariz.

According to one embodiment, the ball launcher user interface 401 provides a player with options to adjust attributes of the ball in real-time per for each pitch. In the embodiment of FIG. 5, the player selects the ball speed and spin. The player may choose different input parameters, for example, the launch angle, the ball length (e.g., the point where the ball first contacts the playing surface), the number of bounces to the wicket 108, and/or the time to reach the wicket 108. Depending on the player's selections, the ball launcher user interface 401 displays different user interfaces for selecting the parameters of the player's choice. Using the player-provided selections, the control circuit determines the launch angle, the speed of the motors 453, and/or other controllable degree of freedom on the ball launcher mechanism 201 to launch a ball with appropriate ball trajectory. In one embodiment, the player selects the ball speed and the ball length, and the launch angle is automatically calculated and determined by the control circuit. If the player selects a slower ball, the launch angle is elevated to maintain the selected ball length. On the other hand, if the player selects a faster ball with the same ball length on the playing surface, the launch angle is lowered as the ball flies faster to make its first bounce at the selected bouncing position.

According to one embodiment, the ball launcher user interface 401 provides an option to select ball attributes from a prescribed recipe (or a look-up table). In another embodiment, the ball launcher mechanism automatically and randomly determines the ball trajectory from an acceptable range of possibilities and provides an additional level of variability and surprise in the game.

Figure 6:
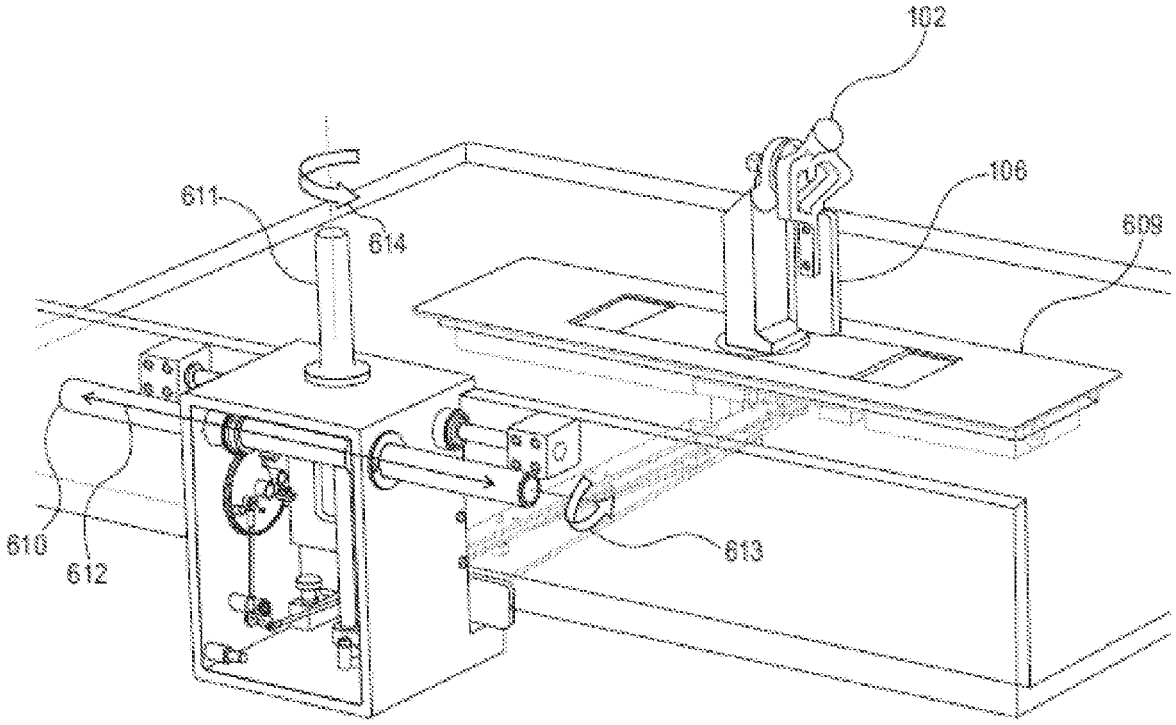
FIG. 6 illustrates an exemplary ball striker mechanism, according to one embodiment.

FIG. 6 illustrates an exemplary ball striker mechanism, according to one embodiment. The batsman 102 is controlled using the batsman control 202. The player places one hand to grasp the rotation handle 611 and another hand on either side of the horizontal handle 610. According to one embodiment, the batsman control 202 provides three degrees of freedom to control the position, angle, and the hitting action of the batsman 102 through gears and mechanical linkages as illustrated in further detail in FIG. 7. The range of motion of the batsman 102 is related to the range of ball trajectories allowed by the ball launcher mechanism 201.

Figure 7:
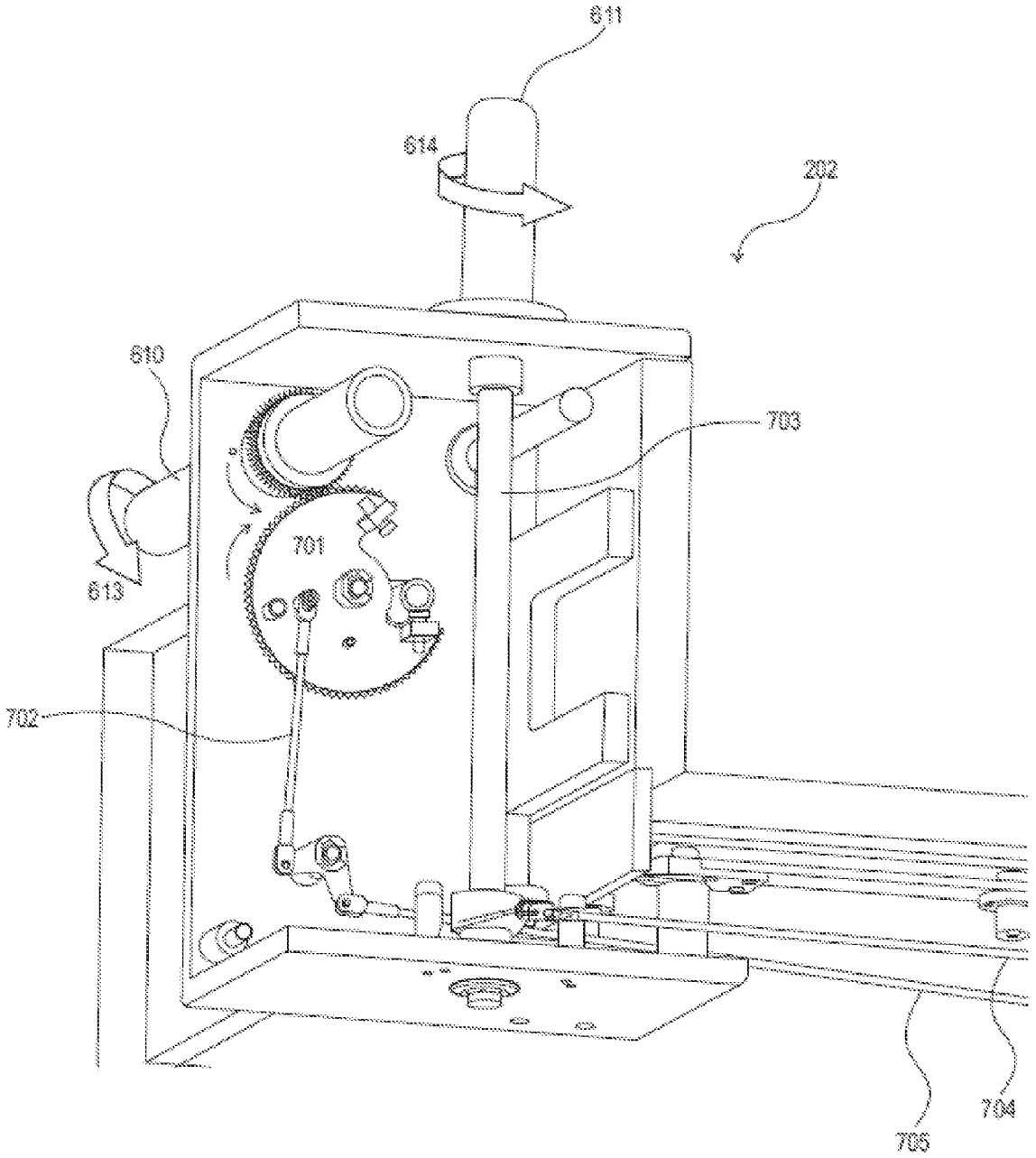
FIG. 7 illustrates details of an exemplary ball striker mechanism, according to one embodiment.

FIG. 7 illustrates details of an exemplary ball striker mechanism, according to one embodiment. The batsman 102 may be made of variety of materials including polypropylene, polyethylene, or acetal to be functional while allowing for aesthetic, cost and manufacturability attributes.

The translational motion of the batsman 102 is achieved by a coupling between the batsman control 202 and the batsman 102. As the player slides the batsman control 202 in the direction of 612, the batsman 102 moves left and right along the plate 609. The batsman 102 rotates about a vertical axis to change its standing angle with respect to the ball launcher mechanism 201. The rotational motion of the batsman 102 is achieved by a linkage between the rotation handle 611 and the batsman 102. The rotation of handle 611 about a vertical axis causes the coupled linkage 704 to push or pull, correspondingly rotating the batsman 102 about its vertical axis.

The ball hitting motion or bat swing is achieved via linkages and gears between the horizontal handle 610 and the bat 106. In one embodiment, the bat 106 is attached to the arms and the torso of the batsman 102. To hit the launched ball, the player swiftly turns the horizontal handle 610 in the direction of 613 to swing the bat 106 of the batsman 102.

Figure 8:
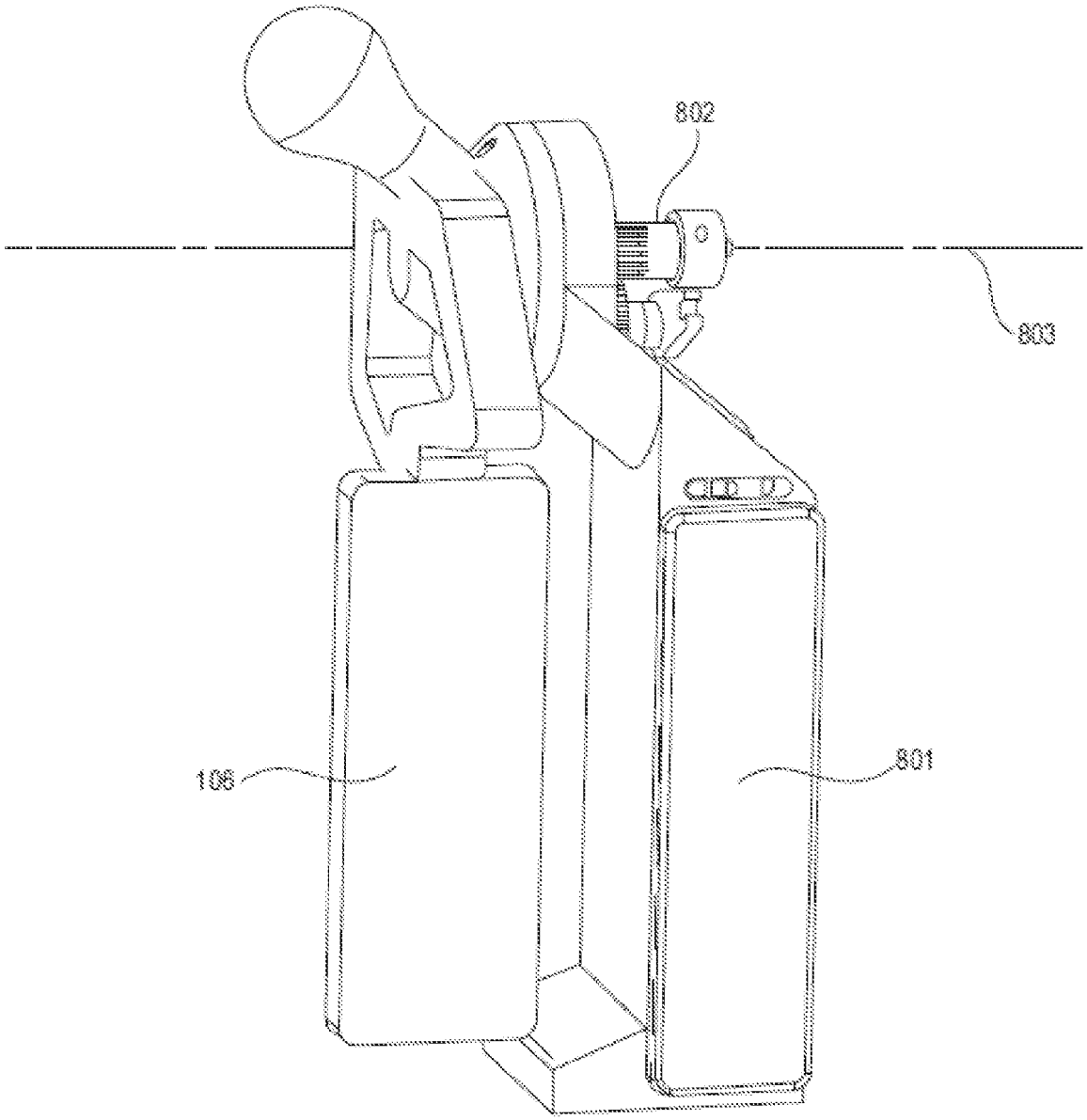
FIG. 8 illustrates an exemplary batsman, according to one embodiment.

FIG. 8 illustrates an exemplary batsman, according to one embodiment. In order to detect mechanical collision of the leg of the batsman 102 with a ball, one or more electrical switches are placed behind the front plate 801 of the batsman 102's leg. When the ball collides with the front panel, an electrical signal is sent to the main computer 160 for data processing. According to one embodiment, the obstruction of the wicket 108 by any part of the batsman 102 is detected by an optical sensor.

According to one embodiment, simple modifications are made to the batsman 102 to resemble other types of ball strikers such as a batter in a baseball or softball game. The linkages and/or gears that actuate the bat 106 are reconfigured to swing the bat 106 substantially parallel to the playing surface. In another embodiment, the batsman 102 may be switched to another ball striker such as a batter in a baseball or softball with the existing linkages and/or gears to play other types of ball games. The fielders 103 may be repositioned on the playing surface and/or substituted with the drains 150. It is appreciated that other modifications, variations, or changes in configuration may be made to play other types of ball games without deviating from the scope of the present subject matter.

According to one embodiment, the batsman 102 is electrically controlled by the batsman control 202 using electrical signals therebetween. The actions of the batsman 102 are accomplished using various electromechanical actuators, for example, servo motors, steppers, or piezoelectric motors.

Figure 9:
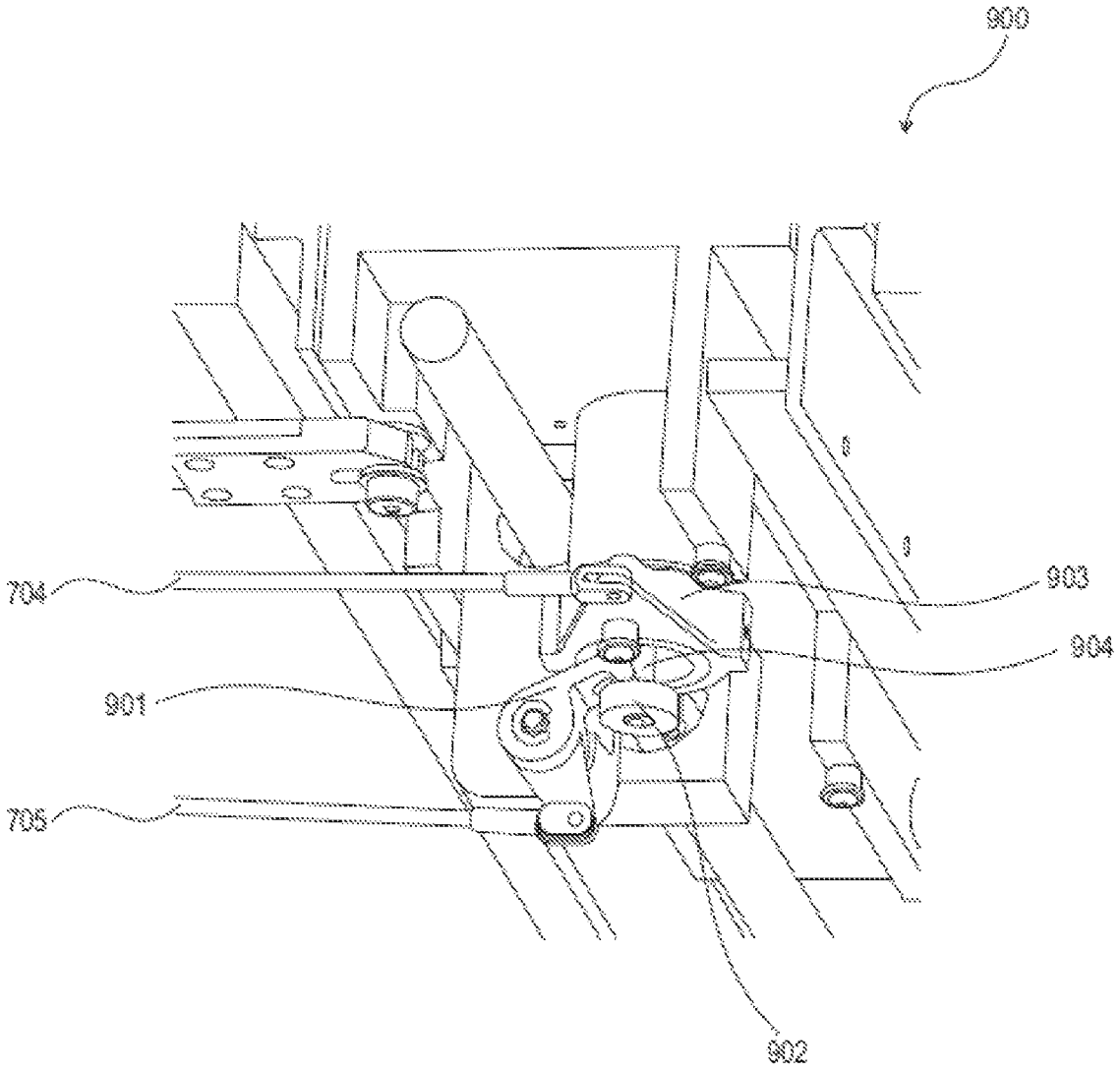
FIG. 9 illustrates an exemplary coupling mechanism between the batsman control and the batsman, according to one embodiment.

FIG. 9 illustrates an exemplary coupling mechanism between the batsman control and the batsman, according to one embodiment. The coupling mechanism 900 is attached to batsman 102 at the bottom below the playing surface of the table game. The turn of the horizontal handle 610 of the batsman control 202 rotates the coupled gear 701 and pushes or pulls the coupled linkages 702 and 705. The translational motion of linkage 705 caused by the turn of the horizontal handle 610 lifts up and down cam 901 to rotate gear 802. The rotation of gear 802 causes the bat 106 to rotate about the axis 803. The faster the player turns the horizontal handle 610, the faster the bat 106 swings. The increased batting speed generally enhances the chance of hitting the ball farther and scoring higher runs.

Figure 10:
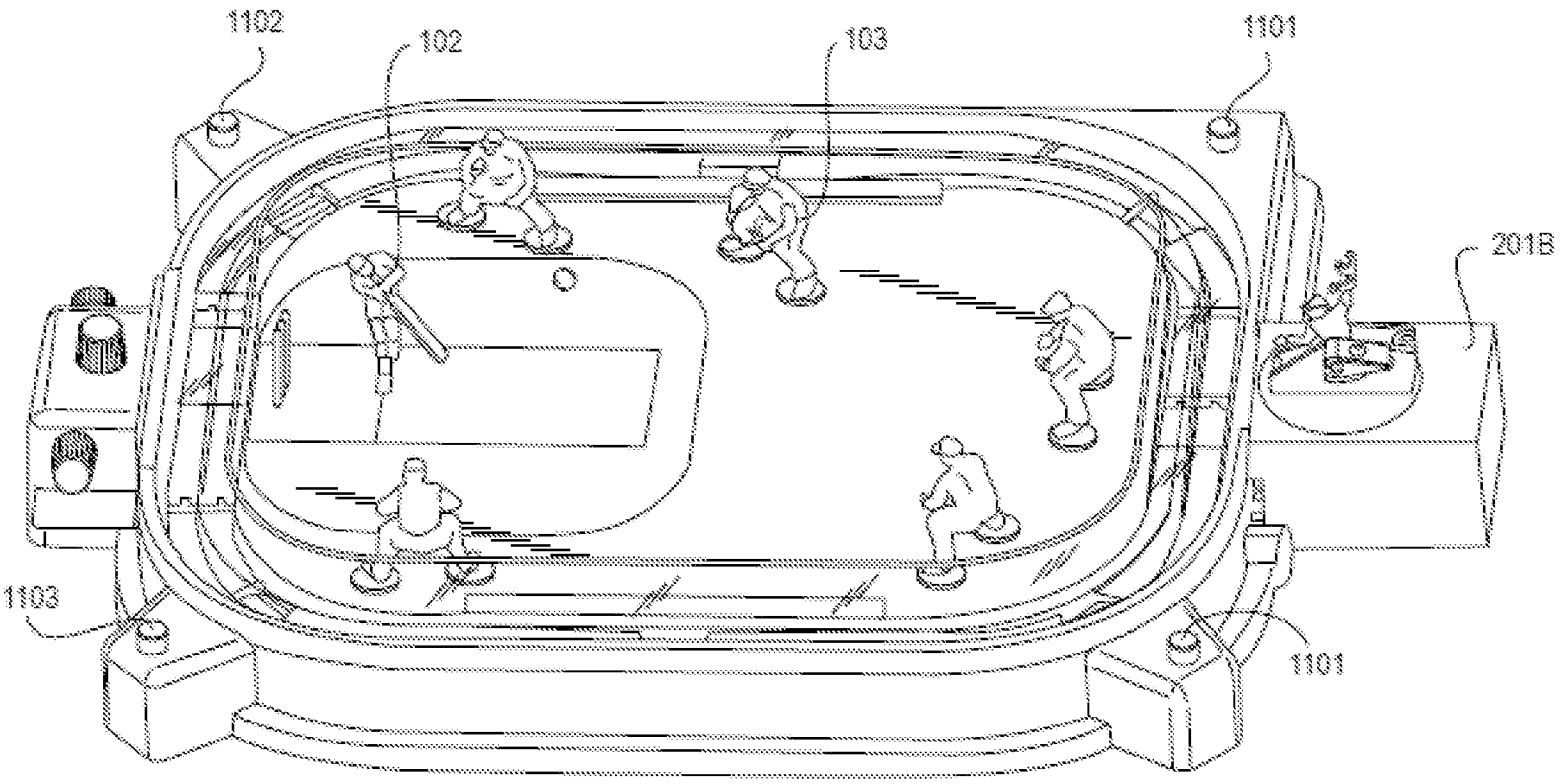
FIG. 10 illustrates an exemplary cricket table game, according to another embodiment.

FIG. 10 illustrates an exemplary cricket table game, according to another embodiment. The "Caught-out" buttons 1101 are used to signal that the batsman 102 is caught. Players can place fielders 103 anywhere on the field. Customized fielders 103 of different shapes, colors, and sizes may be used. As soon as a ball is trapped in a fielder 103, a player pushes the "Caught-out" buttons 1101, and the batsman is considered out. The batsman 102 pushes a sixer "out-of-the-park" button 1102 to record a six run when a ball is hit out of the field and the ball is unable to be detected by the outer gutter 152. Umpire Review button 1103 is used to reverse the outcome of any ball, if both teams agree that point to be replayed. For example, a replay of the last ball can be declared using the umpire review button 1103 if, for example, all players agree that the last ball was bowled before the batsman was ready. Umpire Review button 1103 enables users to replay the last ball and potentially change the outcome of the last event.

Figure 11A:
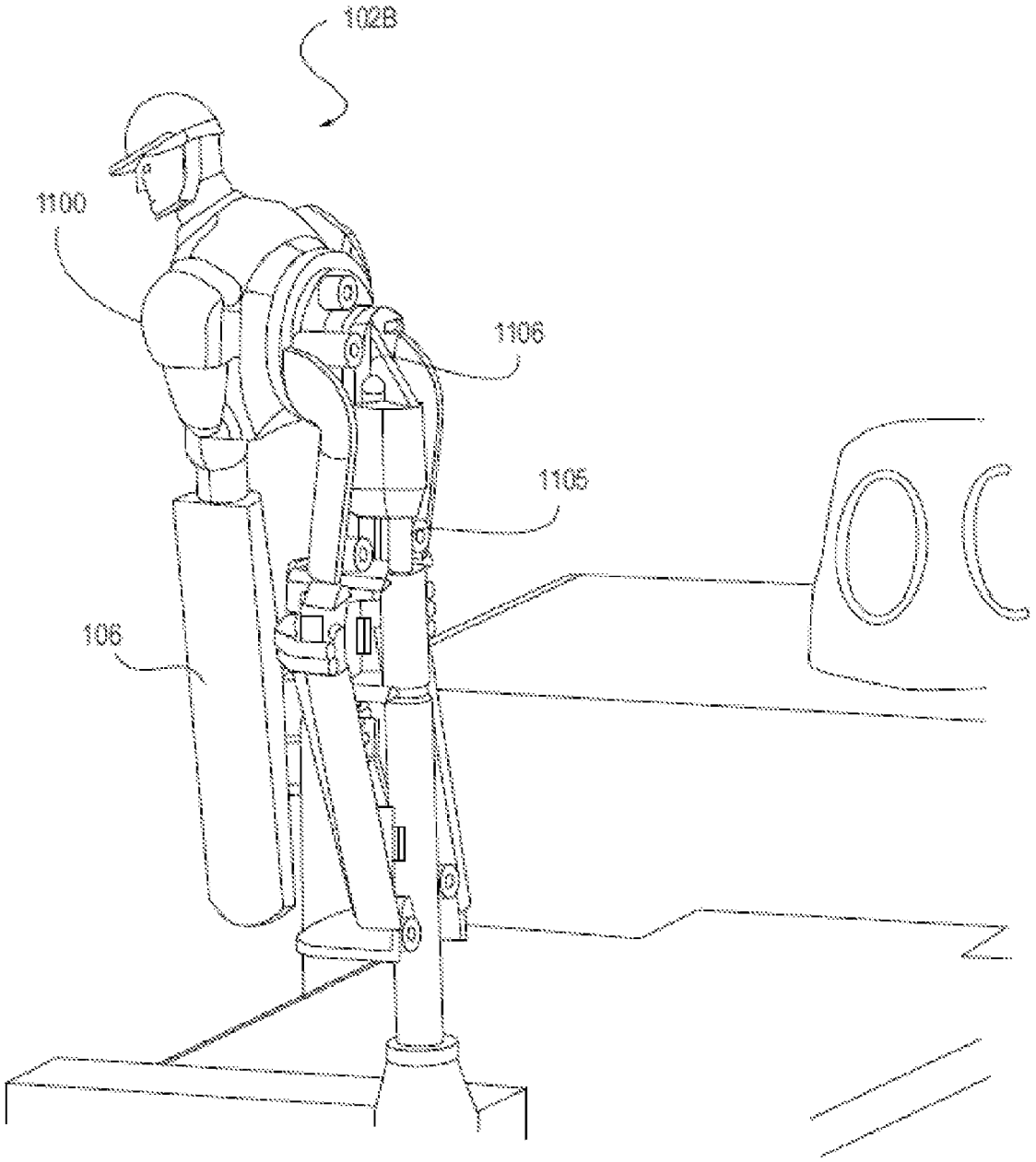
FIGS. 11A and 11B illustrate another exemplary ball striker mechanism, according to one embodiment.
Figure 11B:
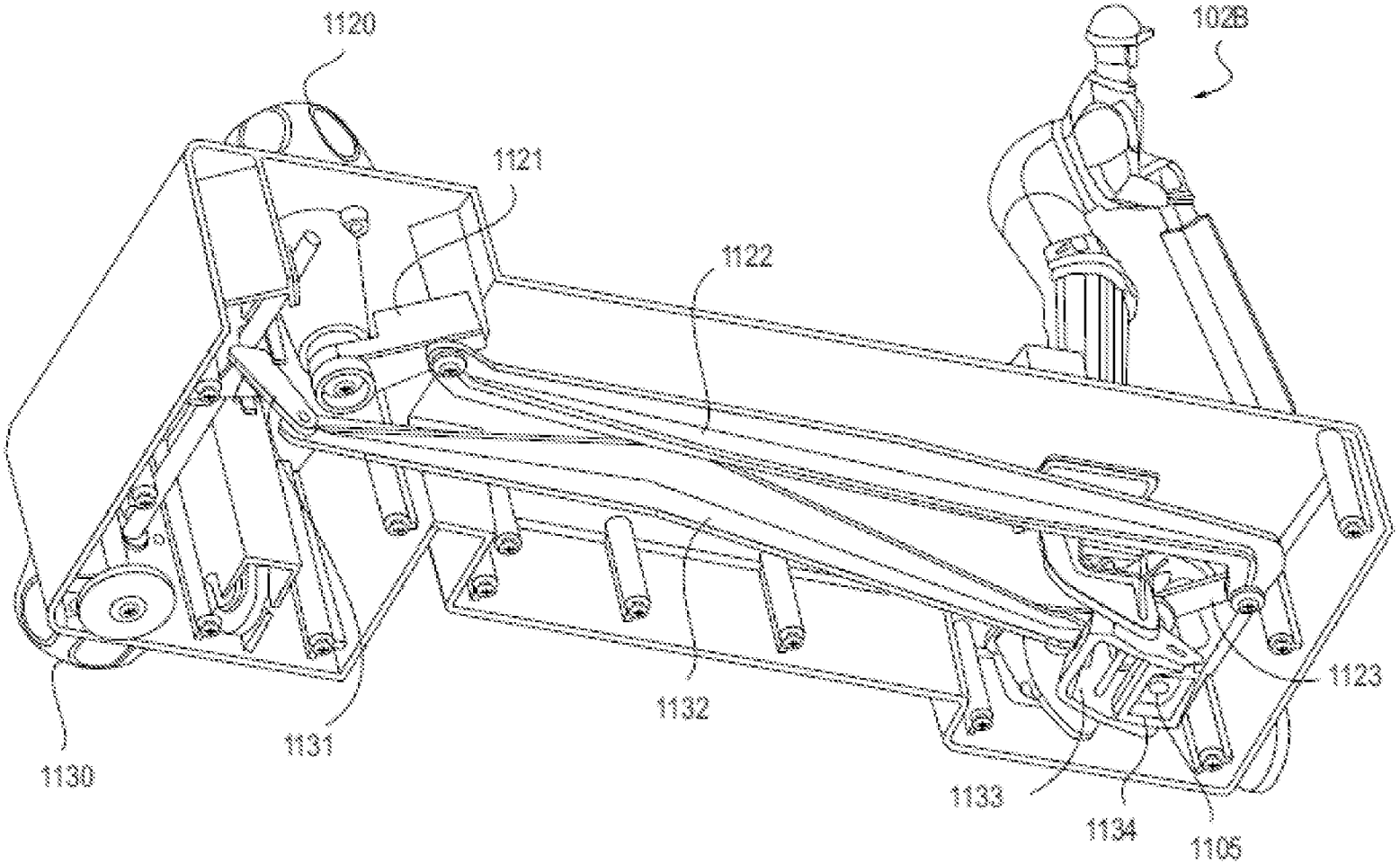
Figure 11C:
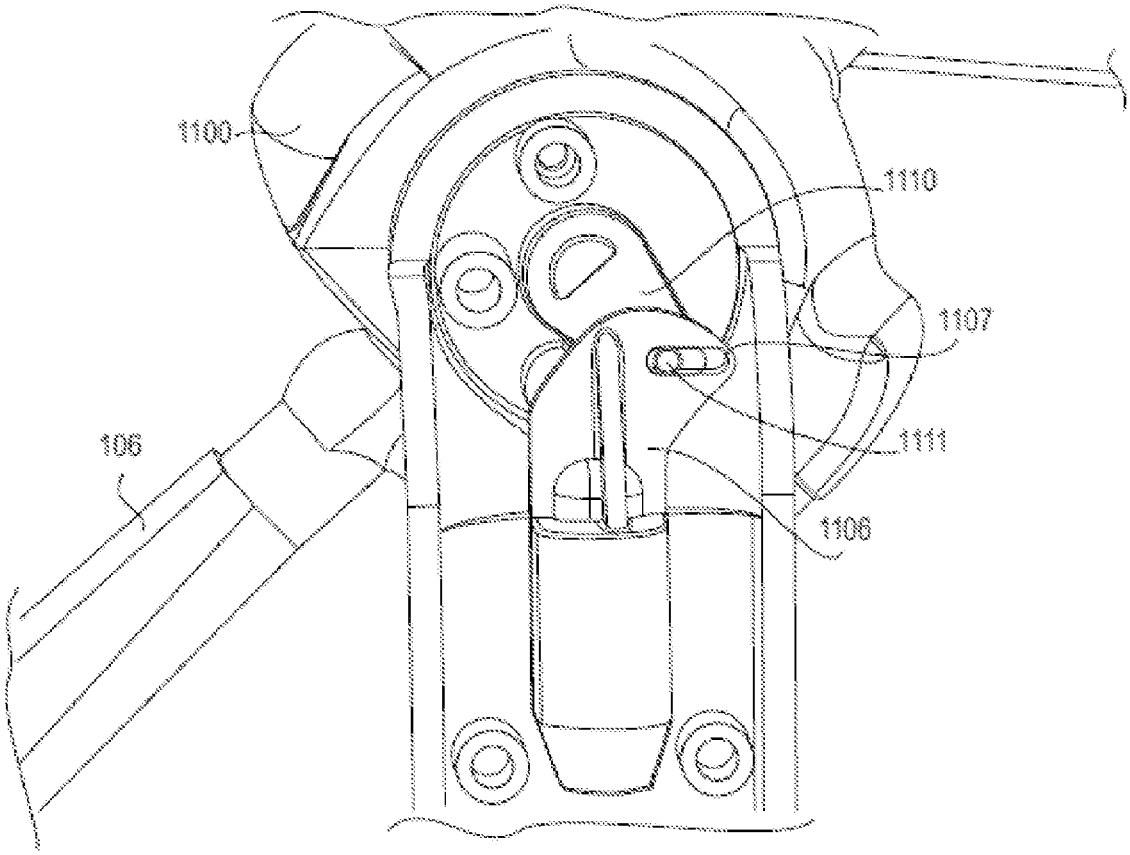
FIG. 11C illustrates a rear view of the torso of an exemplary ball striker mechanism, according to one embodiment.

FIGS. 11A and 11B illustrate another exemplary ball striker mechanism, according to one embodiment. FIG. 11C illustrates a rear view of the torso of the exemplary ball striker mechanism of FIGS. 11A and 11B. The up/down motion of the hitting rod 1105 results in the up/down motion of the hitting hook 1106. The hitting hook 1106 has a horizontal slot 1107 skewed from the line of motion of the hitting rod 1105. The batsman torso 1100 has a crank 1110 having a crank pin 1111 at the end. The crank pin 1111 is mated with the horizontal slot 1107 of the hitting hook 1106 such that the up/down motion of the hitting rod 1105 is translated into the rotational motion the batsman torso 1100. The rotation of the batsman torso 1100 rotates the bat 106 to strike the ball.

The player controlling the ball striker mechanism 102B turns the rotation knob 1120, turns the rotation crank 1121 which moves the rotation link 1122 in and out relative to the ball striker mechanism 102B, and results in rotation of the ball striker mechanism 102B. The player also turns either of the hitting knob 1130 which rotates the hitting crank 1131, moves the hitting link 1132 in and out. This action forces rotation of the hitting crank 1133, which translates into up/down motion of the hitting rod 1105 by the cam 1134.

According to one embodiment, the user interface on the display 140 or the screen of a computing device controlling the table game allows team or individual play. The user interface also provides various game modes such as batting practice, limited overs, test match, etc. The software application of the table game may incentivize the team or players in real-time depending on certain events or actions. The software also tracks player scores and stores and displays short term and long term statistics. The software stores detailed player and team statistics in real time locally and/or to a web server, enabling access to this statistical information via the software application and also via a website. The software application may also display advertisements during the course of a game.

While the present system has been shown and described herein in what is considered to be the preferred embodiments thereof, illustrating the results and advantages over the prior art obtained through the present invention, and the present subject matter is not limited to the specific embodiments described above. Thus, the forms shown and described herein are to be taken as illustrative, and other embodiments may be selected without departing from the spirit and scope of the present subject matter.

Embodiments as described herein have significant advantages over previously developed implementations. As will be apparent to one of ordinary skill in the art, other similar apparatus arrangements are possible within the general scope. The embodiments described above are intended to be exemplary rather than limiting, and the bounds should be determined from the claims.

What is claimed is:

1. A table game comprising:

a playing field having a surface;

a mechanical ball launcher comprising:

a body that rotates about a first axis, the body having a launch arm that extends along a second axis that is substantially perpendicular to the first axis, wherein the launch arm has a ball receptacle at a terminal end of the arm, and wherein the ball receptacle has an opening adapted to receive a ball;

a supporting plate;

a mechanical spring connected between the body and the supporting plate, wherein the mechanical spring is placed in a loaded position when the launch arm is pulled back; and a turn table that rotates the body about a third axis that is substantially perpendicular to the first axis, wherein a launch angle and a speed of the ball are adjusted as the ball is launched from the ball receptacle of the mechanical ball launcher.

2. The table game of claim 1 further comprising a timer and a plurality of sensors, wherein different scores are awarded by measuring a time by the timer from a first moment when the ball is launched to a second moment when the ball is reached to one of the plurality of sensors.

3. The table game of claim 1 further comprising a plurality of switches for user-intervention.

4. The table game of claim 1 further comprising a ball striking mechanism and a plurality of fielders, wherein the ball striking mechanism is capable of hitting the ball launched by the mechanical ball launcher, and the plurality of fielders catch the ball hit by the ball striking mechanism.

5. The table game of claim 1 further comprising a control circuit board that communicates with a PC or a mobile device in real-time.

6. The table game of claim 1 further comprising at least one button to register an event by a player during a game play.

7. The table game of claim 1, wherein the surface of the playing field comprises a pitch surface covered with a material that provides variation and unpredictability on the bounce of the ball.

8. The table game of claim 1 further comprising a button that enables players to dispute and change the decision of the last play, or to replay the last ball.

9. The table game of claim 1 further comprising a control circuit board that communicates in real-time with a computer or a mobile device having a display, and wherein the display displays a scoreboard and events occurring during a game play.

10. The table game of claim 9, wherein the computer or the mobile device sends game scores and statistical information of the game play to a server, and the server enables access to the game scores and statistical information via a software application or a website.

11. A mechanical ball launcher for a table game comprising:

a body that rotates about a first axis, the body having a launch arm that extends along a second axis that is substantially perpendicular to the first axis, wherein the launch arm has a ball receptacle at a terminal end of the arm;

a supporting plate;

a mechanical spring connected between the body and the supporting plate, wherein the mechanical spring is placed in a loaded position when the launch arm is pulled back, and a turn table that rotates the body about a third axis that is substantially perpendicular to the first axis, wherein a ball is launched from the ball receptacle, and wherein a launch angle and a speed of the ball are adjusted as the ball is launched from the ball receptacle.

12. The mechanical ball launcher of claim 11 further comprising a launch angle knob and a mechanical stop connected to the launch angle knob, wherein the launch angle is adjusted by adjusting the launch angle knob.

13. The mechanical ball launcher of claim 12, wherein the position of the mechanical stop is adjusted by moving the launch angle knob to a desired launch angle of the ball.

14. The mechanical ball launcher of claim 13, where the launch angle of the ball is in the range of 10-40 degrees.

15. The mechanical ball launcher of claim 12, wherein the body is rotated by pushing the launch arm against the mechanical spring to cause a deceleration against the mechanical stop.

16. The mechanical ball launcher of claim 15, wherein the ball is thrown out of the ball receptacle by the deceleration of the body against the mechanical stop.

17. The mechanical ball launcher of claim 11 further comprising a pull-back limiter to adjust the speed of the ball.

18. The mechanical ball launcher of claim 11 further comprising one or more sensors for detecting a minimum pull-back angle for a valid throw.

19. The mechanical ball launcher of claim 11 further comprising one or more sensors for detecting a valid ball throw by calculating the time elapsed using output signals from the one or more sensor.

20. The mechanical ball launcher of claim 11 further comprising one or more optical sensors for detecting the launch angle of the ball, wherein the one or more optical sensors determine a valid launch of the ball when the launch angle exceeds a threshold launch angle.

21. The mechanical ball launcher of claim 11 further comprising a turn table, wherein the body is rotated about a third axis perpendicular to the first axis and the second axis to adjust the lateral angle of the ball.

22. The mechanical ball launcher of claim 11, wherein the ball receptacle has an opening to receive the ball and expose a surface of the ball in the ball receptacle, and wherein a player imparts a spin on the ball through the opening of the ball receptacle by touching the surface of the ball as the ball leaves the ball receptacle.

23. The mechanical ball launcher of claim 22, wherein the player imparts the spin using a finger.

* * * * *